US005351728A

United States Patent [19]

Ban et al.

[11] Patent Number: 5,351,728

[45] Date of Patent: Oct. 4, 1994

[54] DEVELOPER CARTRIDGE

[75] Inventors: Yutaka Ban, Tokyo; Mitsuru Honda, Kamagaya; Takuya Hatakeyama, Yokohama, all of Japan

[73] Assignee: Canon Kabushiki Kaisha, Tokyo, Japan

[21] Appl. No.: 159,935

[22] Filed: Dec. 1, 1993

Related U.S. Application Data

[63] Continuation of Ser. No. 11,204, Jan. 29, 1993, abandoned.

[30] Foreign Application Priority Data

Feb. 3, 1992 [JP] Japan ..... 4-046354

[51] Int. Cl.[5] ..... G03G 15/06

[52] U.S. Cl. ..... 141/364; 141/319; 141/395; 222/DIG. 1; 355/260

[58] Field of Search ..... 141/363-366, 141/375, 319-322; 222/DIG. 1; 355/260

[56] References Cited

U.S. PATENT DOCUMENTS

| | | | |
|---|---|---|---|
| 4,142,655 | 3/1979 | Fantuzzo | 222/318 |
| 4,491,161 | 1/1985 | Tamura et al. | 141/364 |
| 4,589,579 | 5/1986 | Morita | 222/DIG. 1 X |
| 4,614,286 | 9/1986 | Yamaguchi et al. | 222/DIG. 1 X |
| 4,650,070 | 3/1987 | Oka | 206/216 |
| 4,799,608 | 1/1989 | Oka | 222/DIG. 1 X |
| 4,834,246 | 5/1989 | Inoue | 206/631 |
| 4,895,104 | 1/1990 | Yoshimo et al. | 222/DIG. 1 X |
| 4,954,844 | 9/1990 | Morita | 355/260 |
| 4,961,450 | 10/1990 | Furata | 141/364 |
| 4,981,218 | 1/1991 | Ban et al. | 206/633 |
| 5,018,560 | 5/1991 | Tsukamoto | 141/364 |
| 5,040,024 | 8/1991 | Fukuda et al. | 355/260 |
| 5,040,025 | 8/1991 | Fuckuchi | 355/260 |
| 5,089,854 | 2/1992 | Kareda et al. | 141/364 X |
| 5,091,750 | 2/1992 | Yoshida | 355/260 |
| 5,153,650 | 10/1992 | Maeshima | 355/260 |
| 5,172,165 | 12/1992 | Hatakeyama et al. | 355/215 |
| 5,175,588 | 12/1992 | Katagata | 355/260 |
| 5,177,540 | 1/1993 | Honda et al. | 355/360 |
| 5,207,353 | 5/1993 | Corby et al. | 222/DIG. 1 X |

FOREIGN PATENT DOCUMENTS

| | | |
|---|---|---|
| 0102002 | 3/1984 | European Pat. Off. . |
| 57-38673 | 8/1982 | Japan . |
| 58-224364 | 12/1983 | Japan . |
| 59-057262 | 4/1984 | Japan . |
| 60-154967 | 10/1985 | Japan . |
| 60-198567 | 10/1985 | Japan . |
| 61-153054 | 9/1986 | Japan . |
| 63-178272 | 7/1988 | Japan . |
| 63-132962 | 8/1988 | Japan . |
| 63-249870 | 10/1988 | Japan . |
| 63-170851 | 11/1988 | Japan . |
| 171761 | 5/1989 | Japan . |
| 171762 | 5/1989 | Japan . |
| 01223483 | 9/1989 | Japan . |
| 3102371 | 4/1991 | Japan . |

*Primary Examiner*—Ernest G. Cusick

*Attorney, Agent, or Firm*—Fitzpatrick, Cella, Harper & Scinto

[57] ABSTRACT

A developer cartridge includes a container having a developer discharge opening, and a table formed around the discharge opening. A slidable plate-shaped lid is slidably mounted on the table, and the lid includes first and second lid portions which are interconnected to each other. A film member is attached to the table and is peelably adhered around the discharge opening. The film member includes a sealing portion for closing the discharge opening, and a second portion folded back over the sealing portion. The second portion extends through the gaps between the first and second lid portions. A grip is fixed to a free end of the second portion of the film member and is provided with an urging portion releasably engaged with a plate surface of the lid.

6 Claims, 20 Drawing Sheets

DEVELOPER CARTRIDGE

This application is a continuation of application Ser. No. 08/011,204 filed Jan. 29, 1993 now abandoned.

BACKGROUND OF THE INVENTION

1. Field of the Invention

The present invention relates to a developer cartridge for replenishing or supplying developer to a developer receiving device of an image forming apparatus, such as an electrophotographic apparatus, wherein an electrostatic latent image is formed and is then developed by the developer.

2. Related Background Art

It is known to provide a developer cartridge that may be mounted on a developer receiving device to replenish developer thereto, and which is removed from the developer receiving device after the developer has been replenished.

In some cases, such a developer cartridge has a slide lid for opening and closing a developer discharge opening formed in the cartridge. In this case, the slide lid is first opened to replenish the developer to the developer receiving device, and, after the developer has been replenished, the developer discharge opening is closed by the slide lid and then the cartridge is removed from the developer receiving device.

The developer comprises black fine powder including particles having an average volume particle diameter of about 2–20 μm, and, thus, has high fluidity. Therefore, when the developer is replenished, it tends to be scattered therearound, thereby smudging the interior of the image forming apparatus and the surrounding environment.

To avoid this, a developer cartridge for replenishing developer to an image forming apparatus without scattering the developer has been proposed, as shown in FIGS. 1, 2 and 3.

Such developer cartridge comprises a container 1 for containing developer to be replenished. The container 1 is provided with a discharge opening 2 for discharging the developer. A table or plate 3 is arranged around the discharge opening 2. The table 3 is provided at its longitudinal edges with bent portions for defining guide grooves.

A plate-shaped lid 4 is mounted on the table 3 for sliding movement between a closed position where the discharge opening 2 of the container 1 is closed by the lid 4, and an open position where the discharge opening 2 is opened. The lid 4 comprises a first portion 5, and a second portion 6 hinged to the first portion 5 with a small gap therebetween.

The first lid portion 5 is provided with a notch 5*a* and a plurality of engagement holes 5*b*. The notch 5*a* is formed widthwise at one edge of the first lid portion 5, and the engagement holes 5*b* are arranged along one longitudinal edge of the first lid portion 5. A plurality of hooked projections 6*a* are formed on the second lid portion 6. These projections 6*a* are arranged along one longitudinal edge of the second lid portion 6. By engaging the projections 6*a* with the corresponding engagement holes 5*b*, the first and second lid portions 5, 6 are interconnected. The longitudinal edges of the lid 4 are inserted into the guide grooves defined by the bent portions of the table 3, so that the lid can be slid with respect to the table while being guided by the guide grooves.

As shown in FIGS. 2 and 3, a flexible film member 7 is attached to the table 3. The film member 7 is peelably adhered around the discharge opening 2 by conventional means such as heat welding, and comprises a first portion, and a second bent portion continuous to the first portion and folded back over the first portion so that it extends through the gap between the first and second lid portions 5, 6 then outwardly therefrom.

A grip 8 is attached to a free end of the bent portion of the film member 7. The grip 8 is provided with a recess 8*a* adapted to releasably engage with one edge of the table 3. When the grip 8 is disengaged from the table 3, the film member 7 can be withdrawn outwardly of the table 3 while sliding the lid 4, thereby opening the discharge opening 2.

However, after the developer has been loaded in the developer cartridge, the latter is moved in certain circulation paths under various environmental conditions until the developer cartridge reaches the user. In particular, under environmental conditions such as vibration, dropping, decompression or high temperature and high humidity, the first and second lid portions 5, 6 may be disconnected from each other, with the result that the film member 7 will often be peeled from the table 3.

For example, under environmental conditions such as vibration, dropping, decompression or high temperature and high humidity, the inner pressure acts on the plate-shaped lid 4 and the film member 7 which seal the discharge opening 2 of the container 1, so that the plate-shaped lid 4 will deform and swell outwardly. As a result, the first and second lid portions 5, 6 which constitute the lid 4 will be disconnected from each other. In particular, since the notch 5*a* is formed at the end of the first lid portion 5 in which the grip 8 is mounted, the rigidity of the end portion of the first lid portion 5 in which the grip 8 is mounted is small or weak, with the result that the connection between the first and second lid portions 5, 6 at that end portion is likely to be broken.

Further, when the connection between the first and second lid portions 5, 6 is broken, the force of the lid 4 holding down the film member 7 will decrease, such that the film member 7 is peeled from the table at a position corresponding to the disconnected area between the first and second lid portions, thus allowing the developer in the container 1 to leak.

Further, since the procedures for replenishing the developer from the developer cartridge to the developer receiving device are relatively complex and the number of such procedures are relatively great, an operator often mistakes the order of the replenishing procedures.

Furthermore, in a developer cartridge wherein the table is secured to the container by screws, the table is sometimes loosened from the container due to vibration which occurs during transportation of the cartridge. In such a case, the developer is apt to leak from the container. In addition, if the table is out of alignment with the container, it is feared that an operator's mishandling may occur.

SUMMARY OF THE INVENTION

A main object of the present invention is to provide an improved developer cartridge.

Another object of the present invention is to provide a developer cartridge which has increased rigidity under environmental conditions such as vibration, dropping, decompression or high temperature and high humidity and which is difficult to damage.

A further object of the present invention is to provide a developer cartridge which can prevent an operator's misoperation during the replenishment of developer.

Other objects and features of the present invention will be apparent from the following description.

DESCRIPTION OF THE PREFERRED EMBODIMENTS

Figure 1:
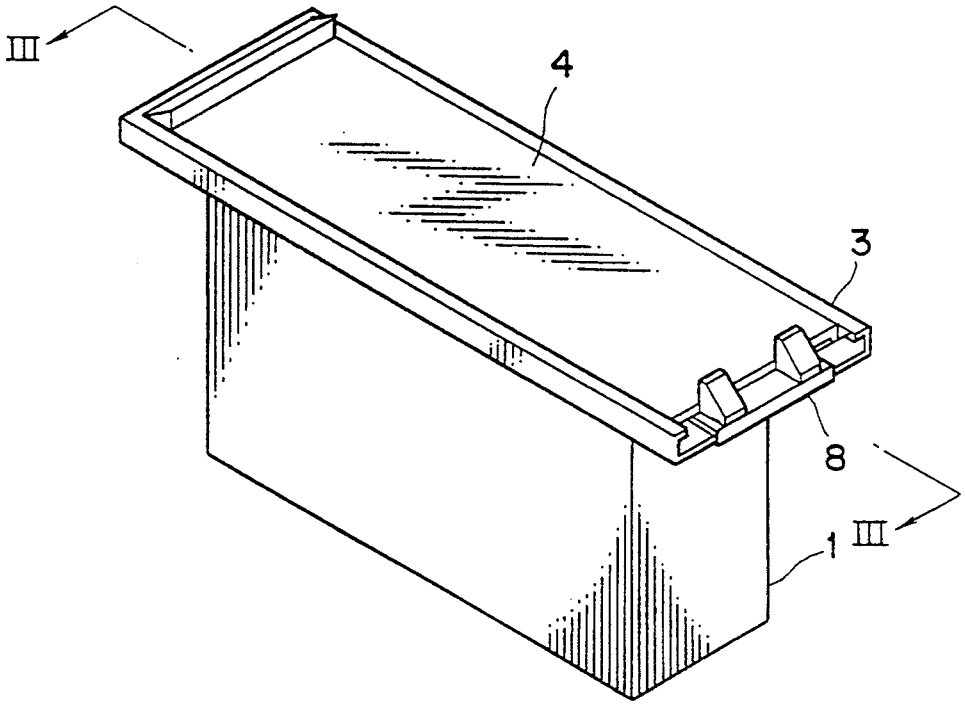
FIG. 1 PRIOR ART
FIG. 1 is a perspective view of a conventional developer cartridge.
Figure 2:
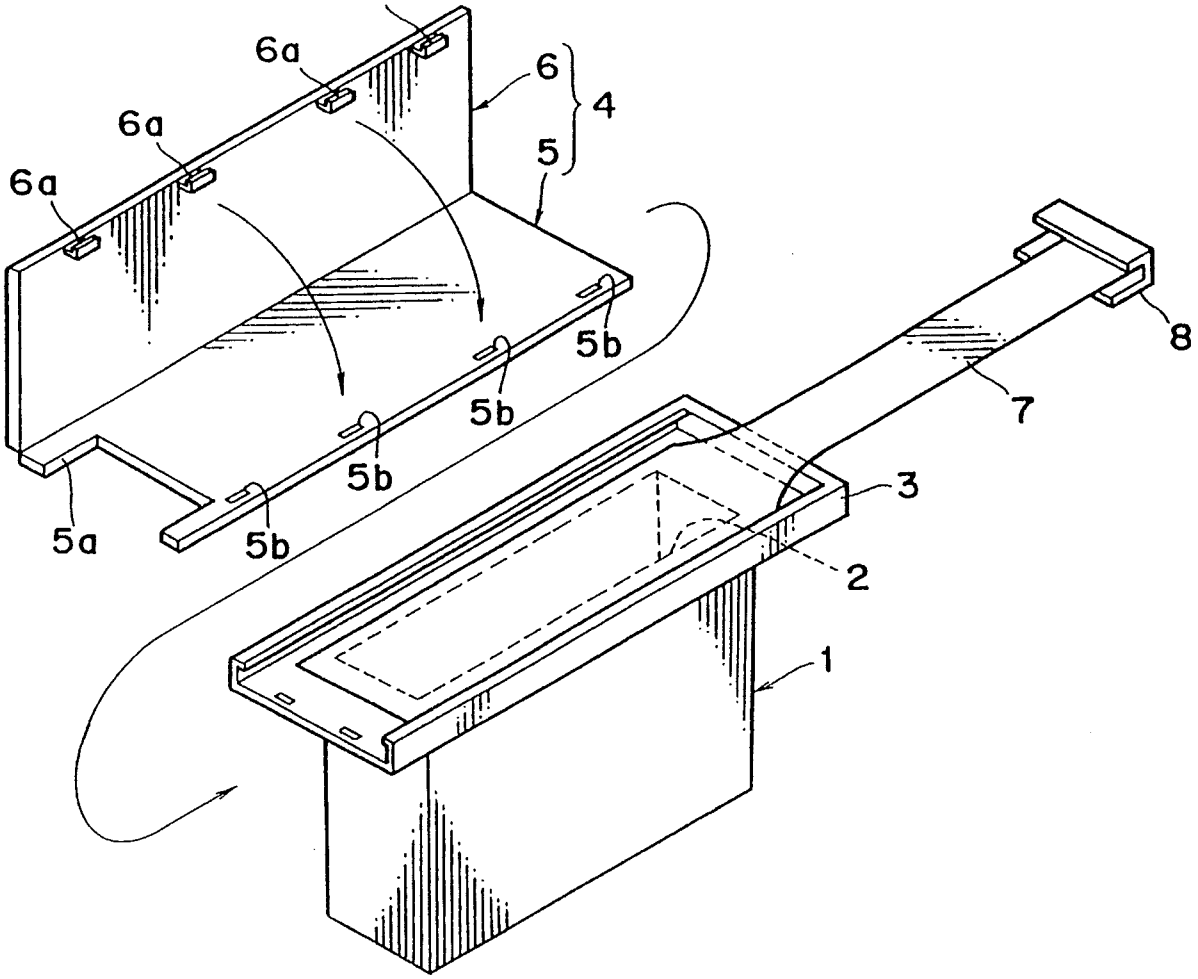
FIG. 2 PRIOR ART
FIG. 2 is an exploded perspective view of the developer cartridge of FIG. 1.
Figure 3:
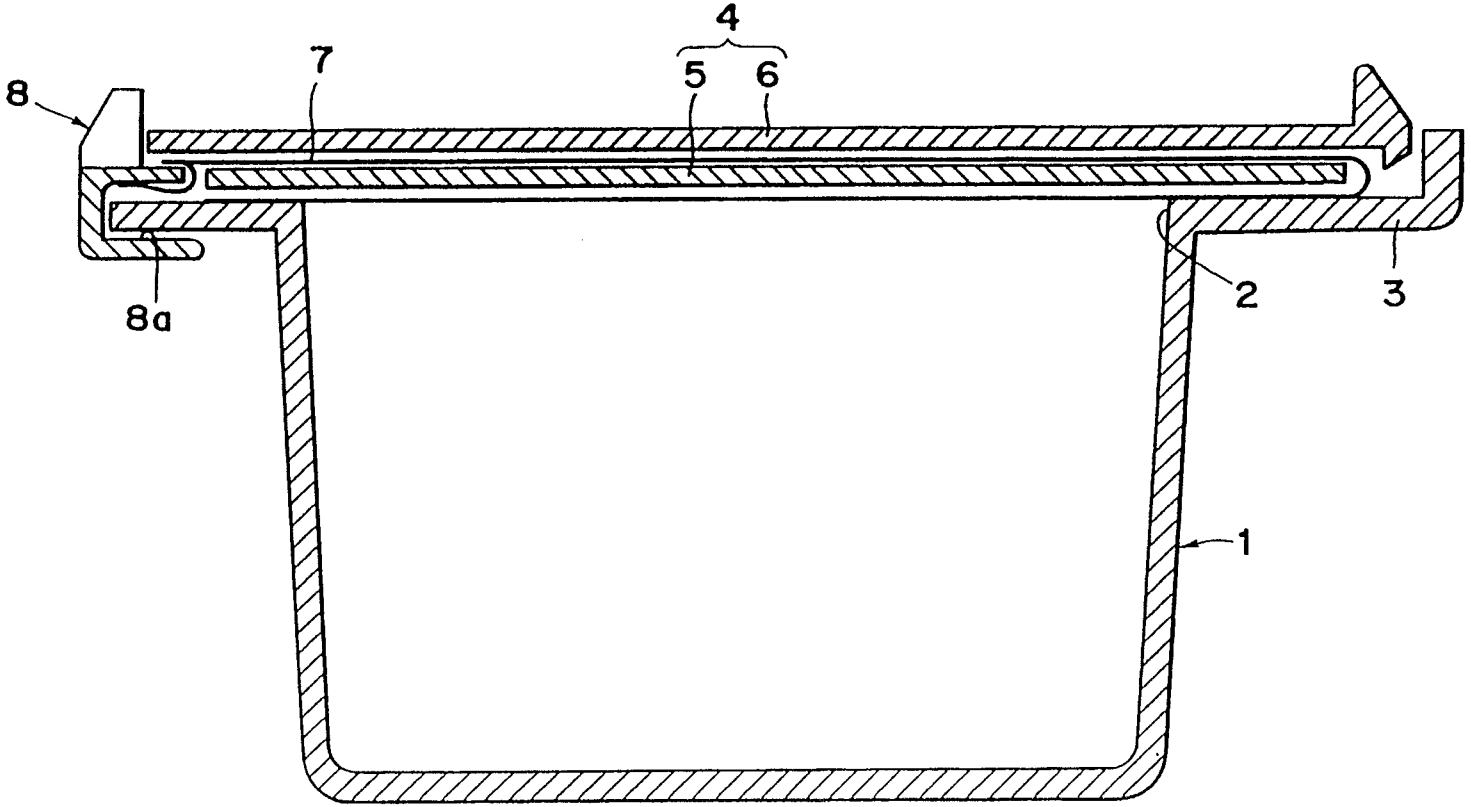
FIG. 3 PRIOR ART
FIG. 3 is a sectional view taken along the line III—III in FIG. 1.
Figure 4:
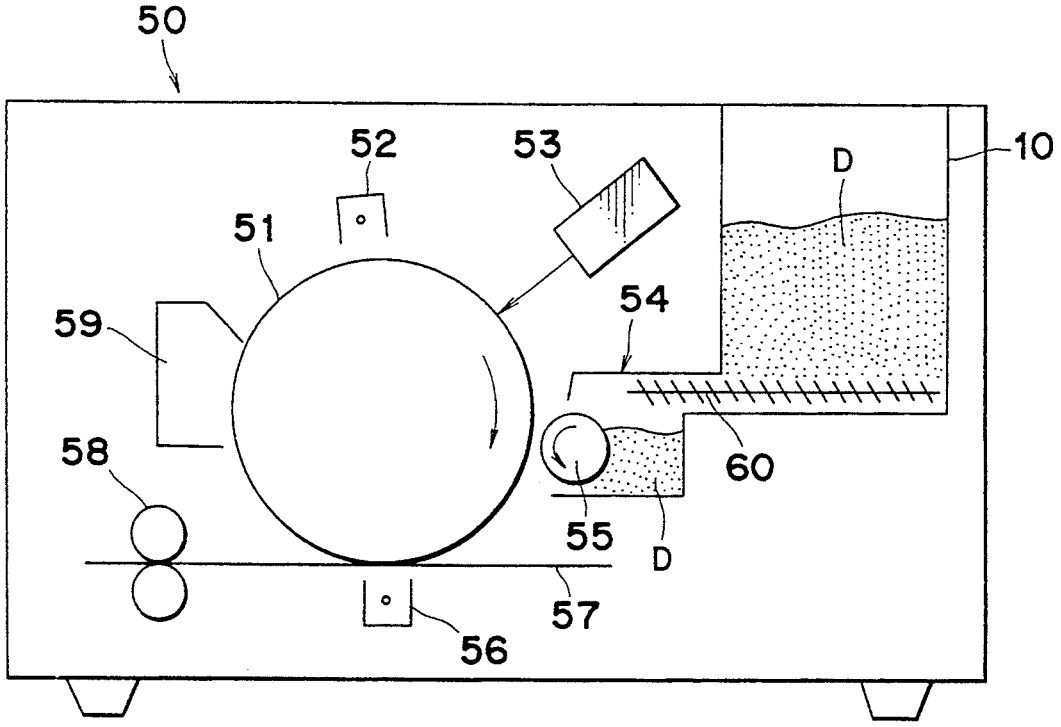
FIG. 4 is a schematic elevational sectional view of an electrophotographic apparatus.

FIG. 4 shows an example of an electrophotographic apparatus within which a developer cartridge according to the present invention can be used.

In FIG. 4, the electrophotographic apparatus 50 has an electrophotographic photosensitive member 51 rotated in a direction shown by the arrow. The photosensitive member 51 first is charged by a charger 52, and then an image light (corresponding an image to be recorded) from an exposure device 53 is illuminated on the charged photosensitive member, thereby forming an electrostatic latent image on the photosensitive member.

The electrostatic latent image is developed by a developing unit 54. The developing unit 54 comprises a developing roller 55 rotated in a direction shown by the arrow. The developing roller 55 serves to carry and convey developer D, thereby to apply it to the electrostatic latent image. A developed image on the photosensitive member is transferred onto a transfer sheet 57 by a transfer charger 56, and the image transferred to the sheet is then fixed to the transfer sheet 57 by a fixing device 58. After the transferring operation, the photosensitive member 51 is cleaned by a cleaning device 59.

In order to replenish the developer used by the developing operation, new developer D is supplied from a developer storage container (hopper) 10 of a developer receiving device to the developing unit 54 via a conveying device 60 such as a screw conveyor.

When the developer D in the hopper 10 is decreased below a predetermined amount, an operator must replenish developer from a developer cartridge to the hopper 10.

As described below, when the developer is to be replenished, the developer cartridge is mounted on the top of the hopper 10, and, after the replenishing operation, the developer cartridge is removed from the hopper 10.

Figure 5:
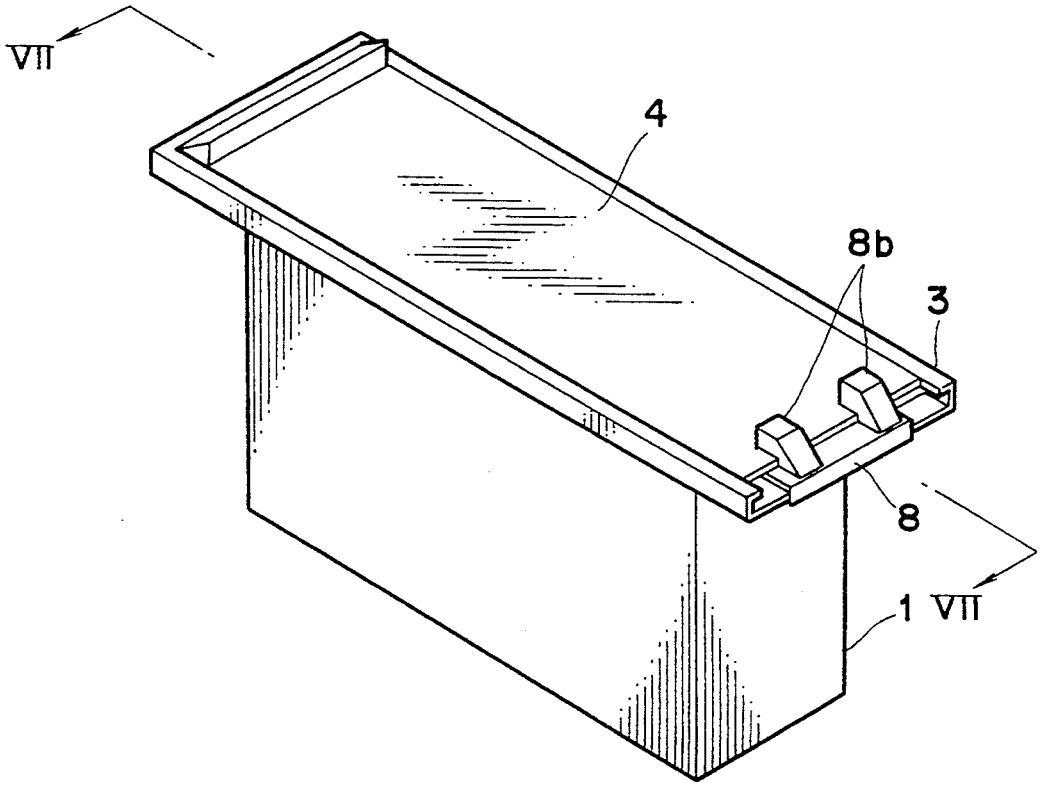
FIG. 5 is a perspective view of a developer cartridge according to a preferred embodiment of the present invention.
Figure 6:
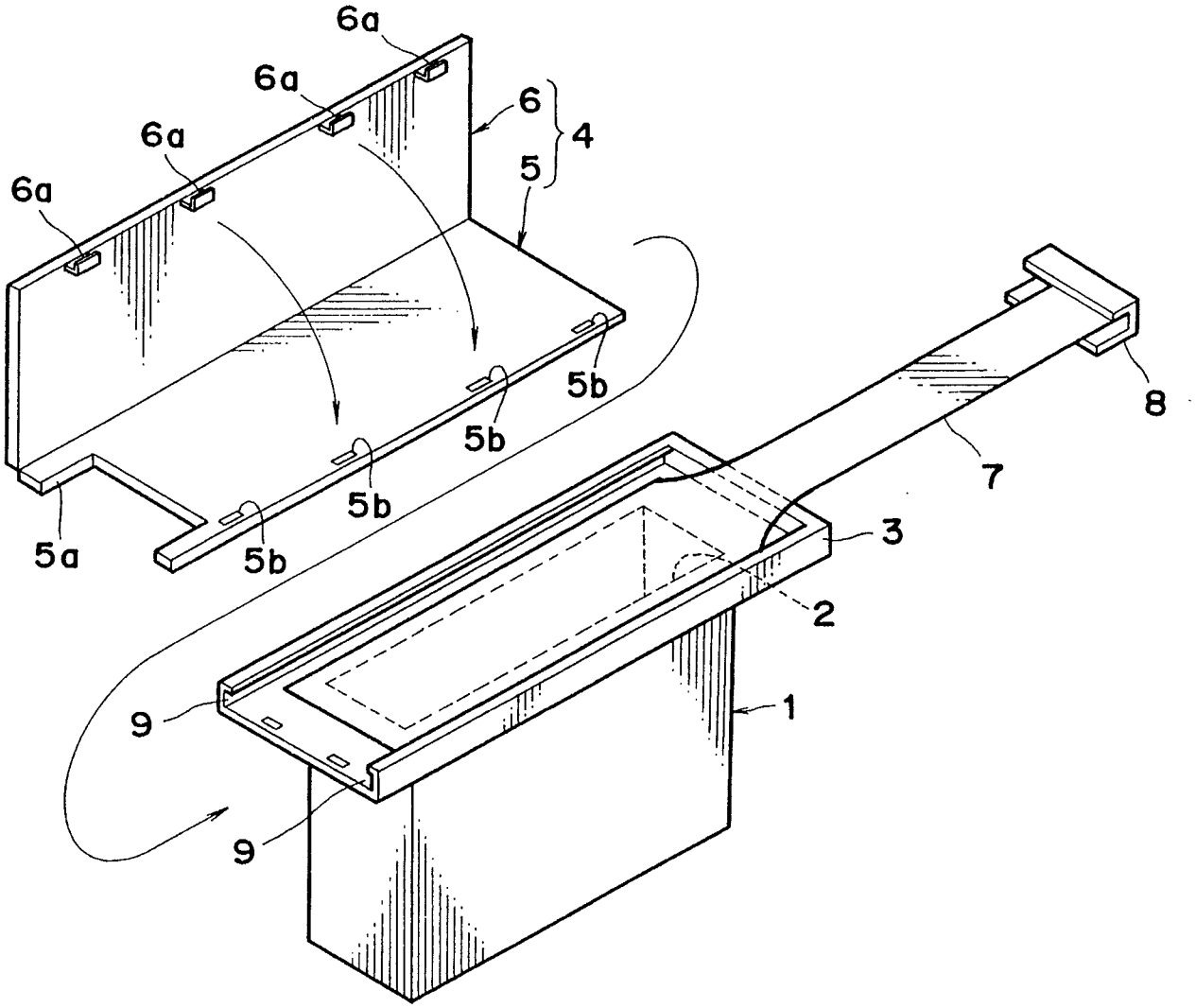
FIG. 6 is an exploded perspective view of the developer cartridge of FIG. 5.
Figure 7:
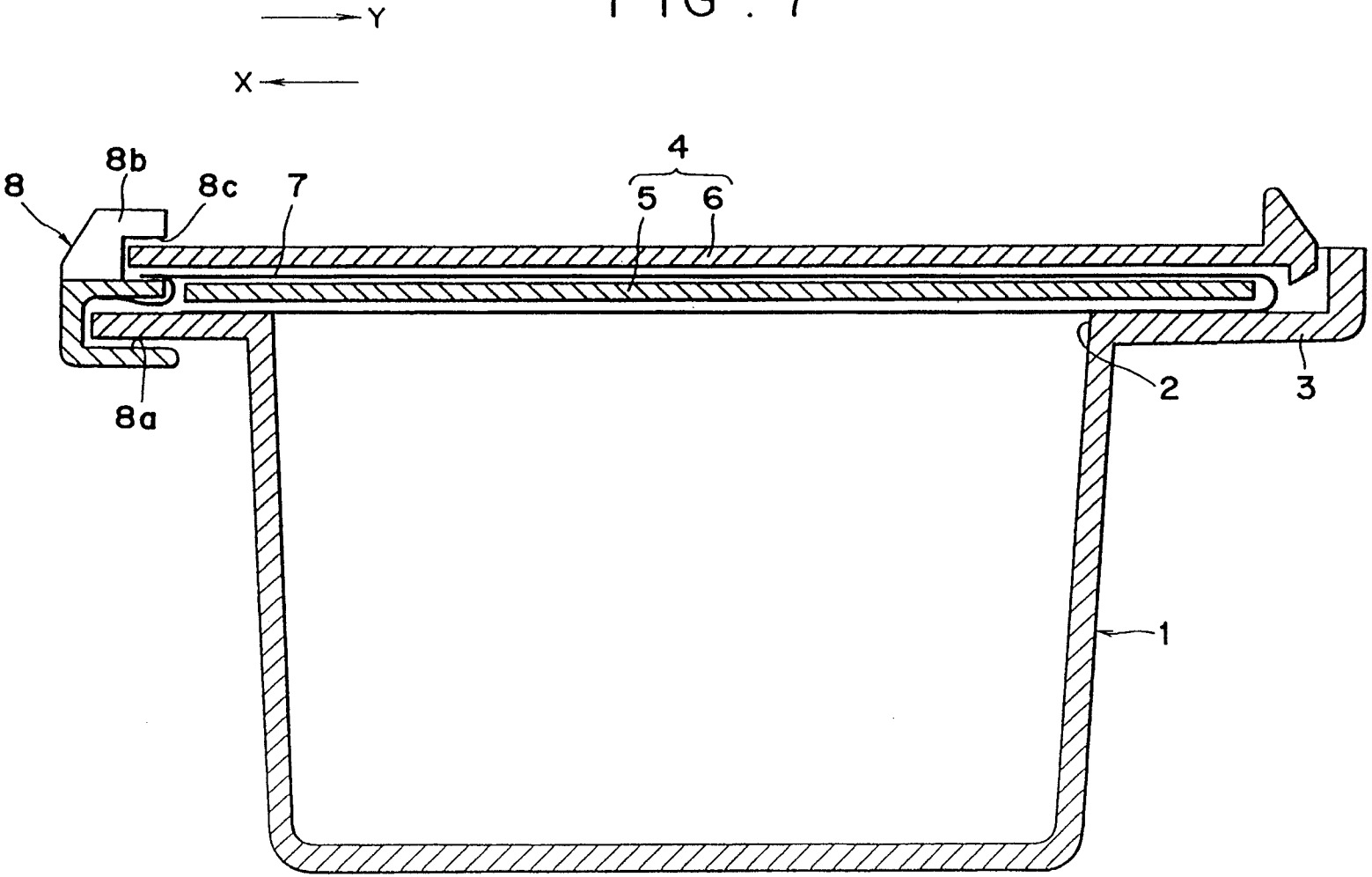
FIG. 7 is a sectional view taken along the line VII—VII in FIG. 5.

As shown in FIGS. 5 to 7, the developer cartridge for replenishing the developer to the hopper of the developer receiving device comprises a container 1 for containing the developer. The container 1 is provided with a discharge opening 2 for the developer. A table or plate 3 is arranged around the discharge opening 2. The table 3 is provided at its longitudinal edges with bent portions for defining guide grooves 9.

A plate-shaped lid 4 is mounted in the guide grooves 9 of the table 3 for sliding movement between a closed position where the discharge opening 2 of the container 1 is closed by the lid 4 and an open position where the discharge opening 2 is opened. The plate-shaped lid 4 comprises a first plate-shaped portion 5, and a second plate-shaped portion 6 hinged to the first portion 5 with a small gap therebetween. The first and second lid portions 5, 6 are made from elastic synthetic resin plates.

Figure 8:
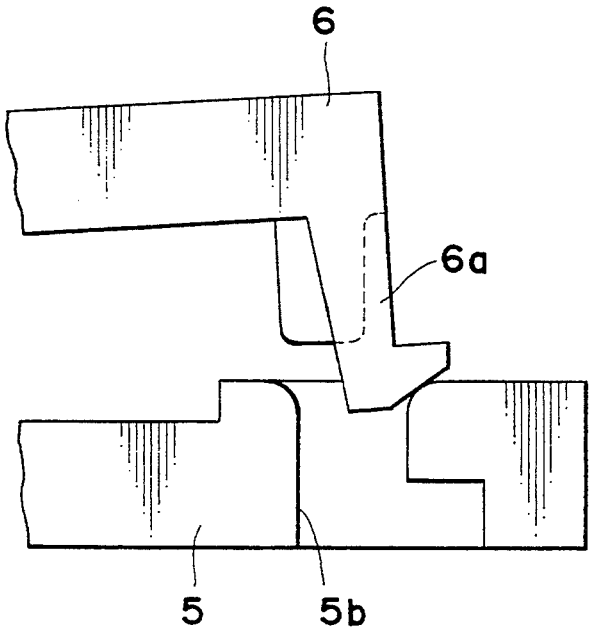
FIGS. 8 and 9 are partial views for explaining the connection between two lid portions.
Figure 9:
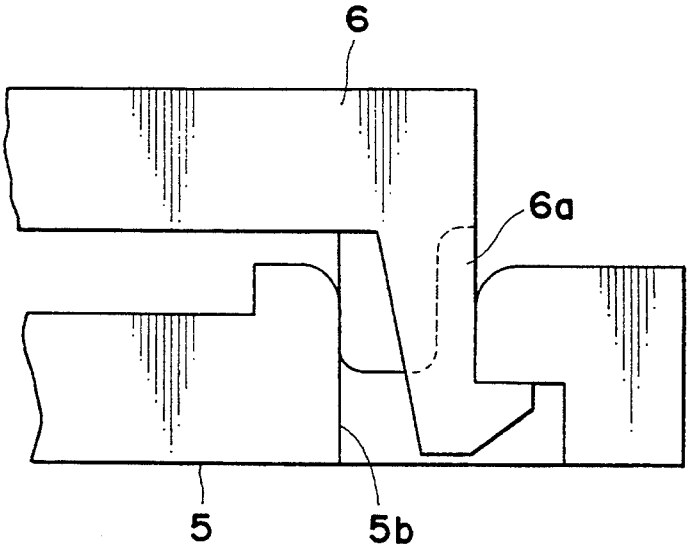

The first lid portion 5 is provided with a notch **5*a* and a plurality of engagement holes 5*b*. The notch 5*a* is formed widthwise at one edge of the first lid portion 5, and the engagement holes 5*b* are arranged along one longitudinal edge of the first lid portion 5. A plurality of engagement projections 6*a* are formed on the second lid portion 6. These engagement projections 6*a* are arranged along one longitudinal edge of the second lid portion 6. As shown in FIGS. 8 and 9, by engaging the engagement projections 6*a* with the corresponding engagement holes 5*b*, the first and second lid portions 5, 6** are interconnected.

That is to say, each projection **6*a* has a hooked shape. By inserting each projection 6*a* into the corresponding engagement hole 5*b* while elastically deforming the projection, the hooked portion of the projection 6*a* is locked against a locking surface of the engagement hole 5*b*. Incidentally, such hooked projections may be formed on the first lid portion 5 and the corresponding engagement holes may be formed in the second lid portion 6**.

As shown in FIGS. 6 and 7, a flexible film member 7 made of synthetic resin is attached to the table 3. The film member 7 is peelably adhered around the discharge opening 2 by conventional means, such as heat welding, and comprises a first portion for sealingly closing the discharge opening 2, and a second portion continuous with the first portion and folded back over the first portion as shown in FIG. 7. As shown therein, the second portion of the film member extends through the gap formed between the first and second lid portions 5, 6. The overall length of the film member 7 is selected so that it is two or more times a longitudinal length of the discharge opening 2.

A grip 8 is attached to a free end of the second portion of the film member 7. The grip 8 is provided with a recess 8*a* adapted to releasably engage with one widthwise edge of the table 3, and a pair of projections 8*b*. Between each projection 8*b* and the body of the grip 8, there is formed a groove 8*c* which can be releasably engaged with the edge of the second lid portion 6. That is to say, the outer surface of the plate-shaped lid 4 is engaged and held down by the projections 8*b* of the grip 8 in a direction perpendicular to a plane of the lid.

In the illustrated embodiment, the surface of the second or outer lid portion 6 is held down by the projections 8*b*. This is the most preferable way to prevent any deformation of the lid 4. However, if the first lid portion has no notch 5*a*, projections for holding down the surface of the first lid portion 5 may be provided on the grip 8. Although the grip 8 is normally engaged by the table 3, when the grip 8 is disengaged from a table 3 during the replenishing operation, the projections 8*b* are also disengaged from the lid 4.

Next, the procedures for replenishing the developer from the developer cartridge to the developer receiving device will be explained.

First, the developer cartridge is mounted on the developer receiving device. Then, the operator disengages the grip 8 from the table 3 and the lid portion 6. Then, the grip 8 is pulled in a lid pulling direction (shown by the arrow X in FIG. 7) by the operator, with the result that the second portion of the film member 7 is pulled out while peeling the first portion of the film member from the table 3. As the film member 7 is pulled out, the lid 4 slides in the direction X in accordance with the principle of a "dynamic pulley", thereby gradually opening the discharge opening 2 of the container 1. Further, when film member 7 is pulled out to a predetermined length, the lid 4 reaches the open position where the discharge opening 2 of the container 1 is completely opened. By opening the discharge opening 2 of the container 1, the developer in the container 1 is replenished into the developer receiving device through the discharge opening 2.

Although the developer is adhered to the first portion of the film member 7, when the film member 7 has been pulled out to the predetermined length, the first portion of the film member 7 will be drawn between the first and second lid portions 5, 6. In this manner, the developer adhered to the first portion of the film member is prevented from leaking to the exterior. Thus, the developer adhered to the first portion of the film member 7 is prevented from smudging the operator's hands, his clothes and the surrounding environment.

When the replenishment of the developer is completed, the lid 4 is manually shifted in a direction shown by the arrow Y by the operator. As the lid 4 is shifted in the direction Y, the film member 7 is pulled back into the lid 4, and the grip 8 is shifted up to a position where the grip can be engaged by the second lid portion 6 of the lid 4. In this manner, the discharge opening 2 of the container 1 is closed again by the film member 7 and the lid 4.

Incidentally, the operation in the replenishment of the developer will be fully described later.

When the developer cartridge is exposed to the environmental conditions such as vibration, dropping, decompression or high temperature and high humidity, although the first and second lid portions 5, 6 of the lid 4 start to swelled due to the internal pressure in the container 1, since the surface of the second lid portion 6 is held down by the projections 8*b* of the grip 8, the connection between the first and second lid portions 5, 6 is maintained, thereby preventing the first and second lid portions 5, 6 from being disconnected from each other. Further, since the connection between the first and second lid portions 5, 6 is maintained, the swelling of the film member 7 due to the internal pressure can be suppressed by the lid 4, thereby preventing the first portion of the film member 7 from prematurely peeling from the table 3. Further, since the film member 7 is prevented from peeling from the table 3, it is possible to reduce the adhesion strength between the film member 7 and the table 3, thereby improving the operability for peeling the film member 7 from the table 3.

Environmental tests for the developer cartridge were effected to ascertain the above-mentioned advantage. In such environmental tests, vibration and dropping tests, a decompression test, and a high temperature and high humidity disposition test were effected, and the environmental durability of the developer cartridge was evaluated in each test.

In the vibration test, the developer cartridge was vibrated in each direction of the three-dimensional coordinates for one hour, with a frequency in the range of between 10 Hz and 100 Hz. The frequency was varied at an interval of 2.5 minutes under the acceleration of 1 G by using a vibration testing machine. In the dropping test, after the developer cartridges were packed in a predetermined manner then were disposed under room temperature and low temperature (−5° C.), respectively, for twelve hours, and the developer cartridges were dropped from a predetermined height. Incidentally, the dropping height was 60 cm, and each cartridge was dropped on a concrete surface. In the vibration test and the dropping test, the same samples were used and these tests were effected continuously. Thus, these tests are generically referred to as a "vibration and dropping test".

In the decompression test, the developer cartridge was disposed under a pressure of 460 mmHg for 30 minutes. After such disposition was effected two times, the damage of parts of the cartridge was checked. In the high temperature and high humidity disposition test, after the developer cartridge was disposed under environmental conditions of 45° C. and 85 RH%, the damage of parts of the cartridge was checked.

In the above-mentioned tests under various environmental conditions, it was ascertained that there were no incidences of disengagement between the engagement holes 5*b* of the first lid portion 5 and the engagement projections 6*a* of the second lid portion 6, no incidences of peeling of the film member 7 from the table 3, no incidences of leaking of the developer, and no incidences of damage to the parts of the cartridge.

In the illustrated embodiment, while the container 1 and the table 3 were integrally formed from synthetic resin, in the following embodiments, the container 1 is threaded into the table 3.

Figure 10:
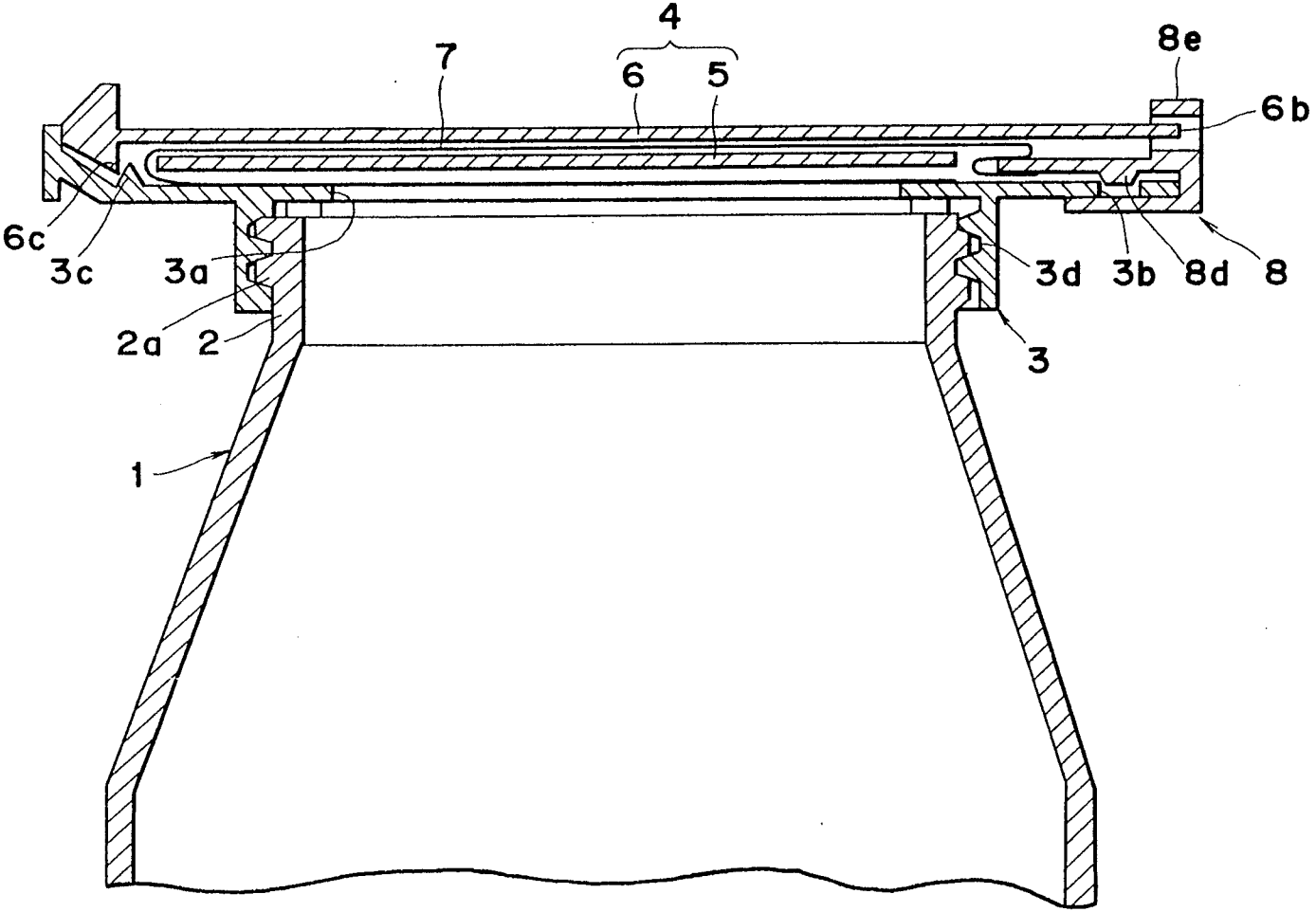
FIG. 10 is a partial sectional view taken along the line X—X in FIG. 11.
Figure 11:
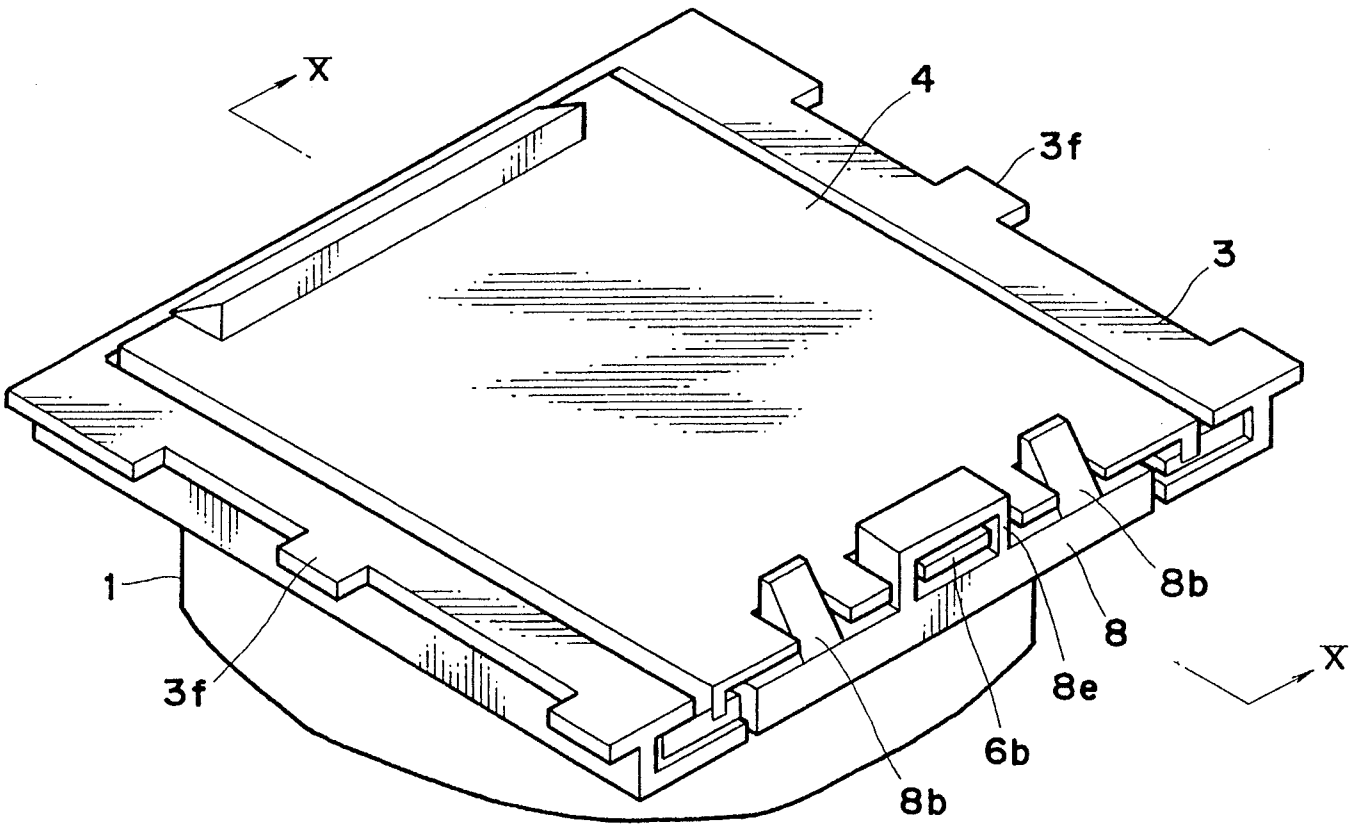
FIG. 11 is a partial perspective view of a developer cartridge according to another embodiment of the present invention.
Figure 12:
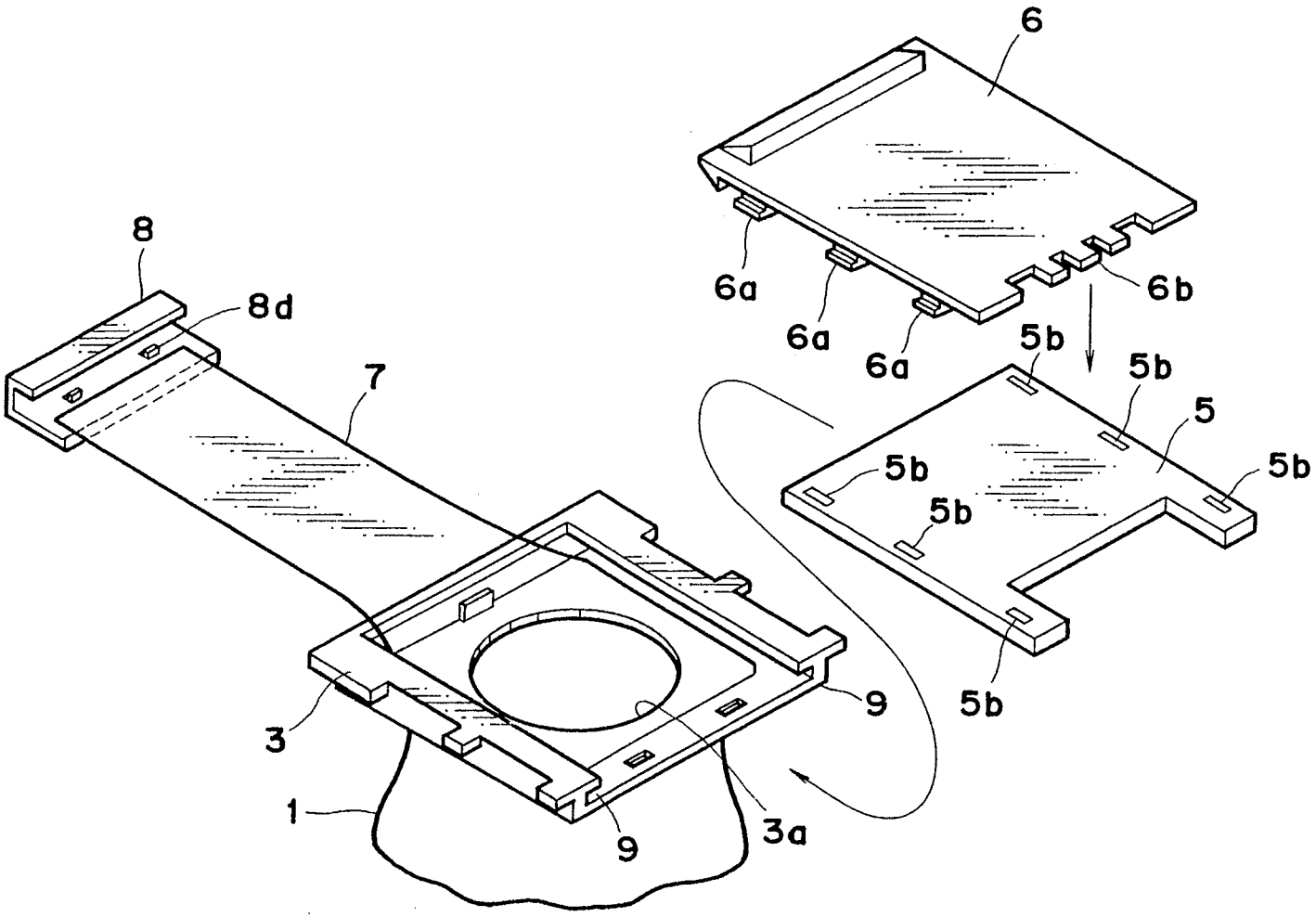
FIG. 12 is an exploded perspective view of the cartridge of FIG. 11.

A developer cartridge shown FIGS. 10 to 12 comprises a container 1 which is made of synthetic resin and which is provided at its upper part with a developer discharge opening 2, and a male threaded portion 2*a* is formed on an outer surface of a wall defining the discharge opening 2. A table 3 is formed independently from the container 1 and is made of elastic synthetic resin. Table 3 is provided with a female threaded portion 3*d*.

The male threaded portion 2*a* of the discharge opening 2 of the container 1 is screwed into the female threaded portion 3*d* of the table 3. The table 3 is further provided with a central opening 3*a* and holes 3*b*, and the central opening 3*a* is disposed coaxially with the discharge opening 2. An upright stopper 3*c* is formed on an upper surface of the table 3.

A second lid portion 6 of a plate-shaped lid 4 is provided with a ridge 6*c* which is adapted to engage with the stopper 3*c* when the discharge opening 2 is completely closed the lid 4. Thus, during transportation of the cartridge, the lid 4 is prevented from sliding to open the discharge opening.

A grip 8 is secured to a free end of a film member 7 and is releasably engaged by the table 3 and the second lid portion 6. The grip 8 is provided with projections 8*d* which are adapted to engage with the holes 3*b* of the table 3, and an insertion opening portion 8*e* which is adapted to receive a peg 6*b* of the second lid portion 6. When the projections 8*d* of the grip 8 are engaged by the holes 3*b* of the table 3, the grip 8 is prevented from disengaging from the lid 4, e.g., during transportation of the cartridge.

Further, when the peg 6*b* of the second lid portion 6 is inserted into the insertion opening portion 8*e* of the grip 8, since the surface of the second lid portion 6 can be held down substantially in a direction perpendicular to the surface of the second lid portion, the connection between the first and second lid portions 5, 6 can be securedly maintained.

Figure 13:
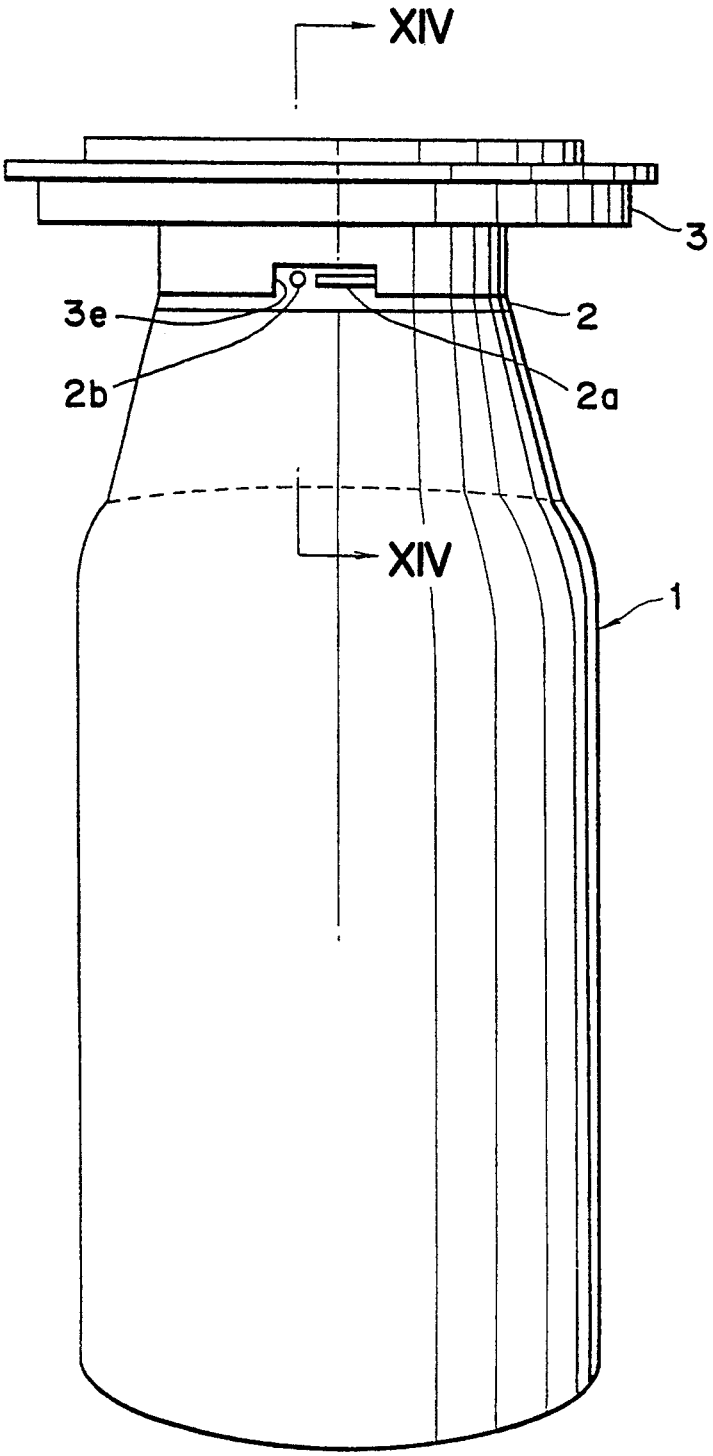
FIG. 13 is a side elevational view of a developer cartridge according to a further embodiment of the present invention.
Figure 14:
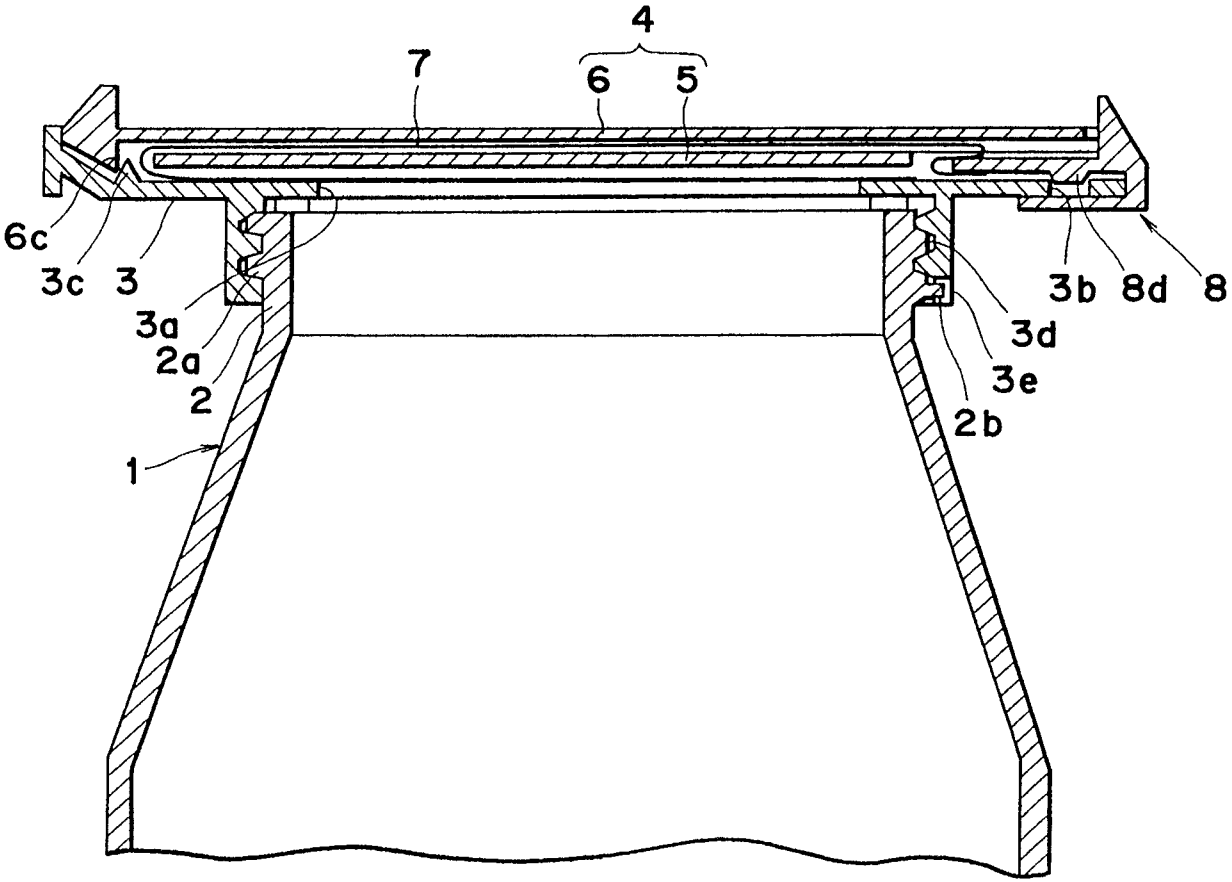
FIG. 14 is a partial sectional view taken along the line XIV—XIV in FIG. 13.
Figure 15:
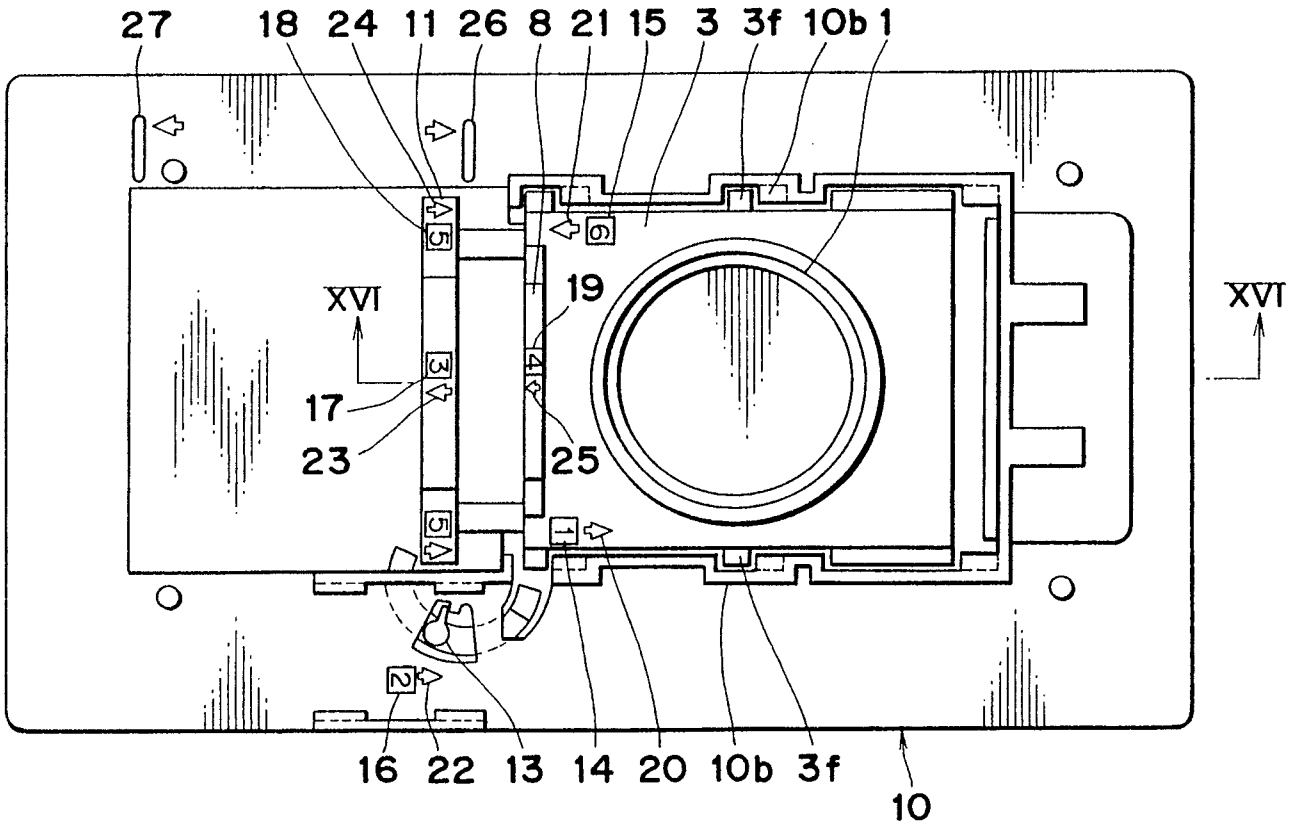
FIG. 15 is a plan view for explaining a process for mounting the cartridge on a developer receiving device.
Figure 16:
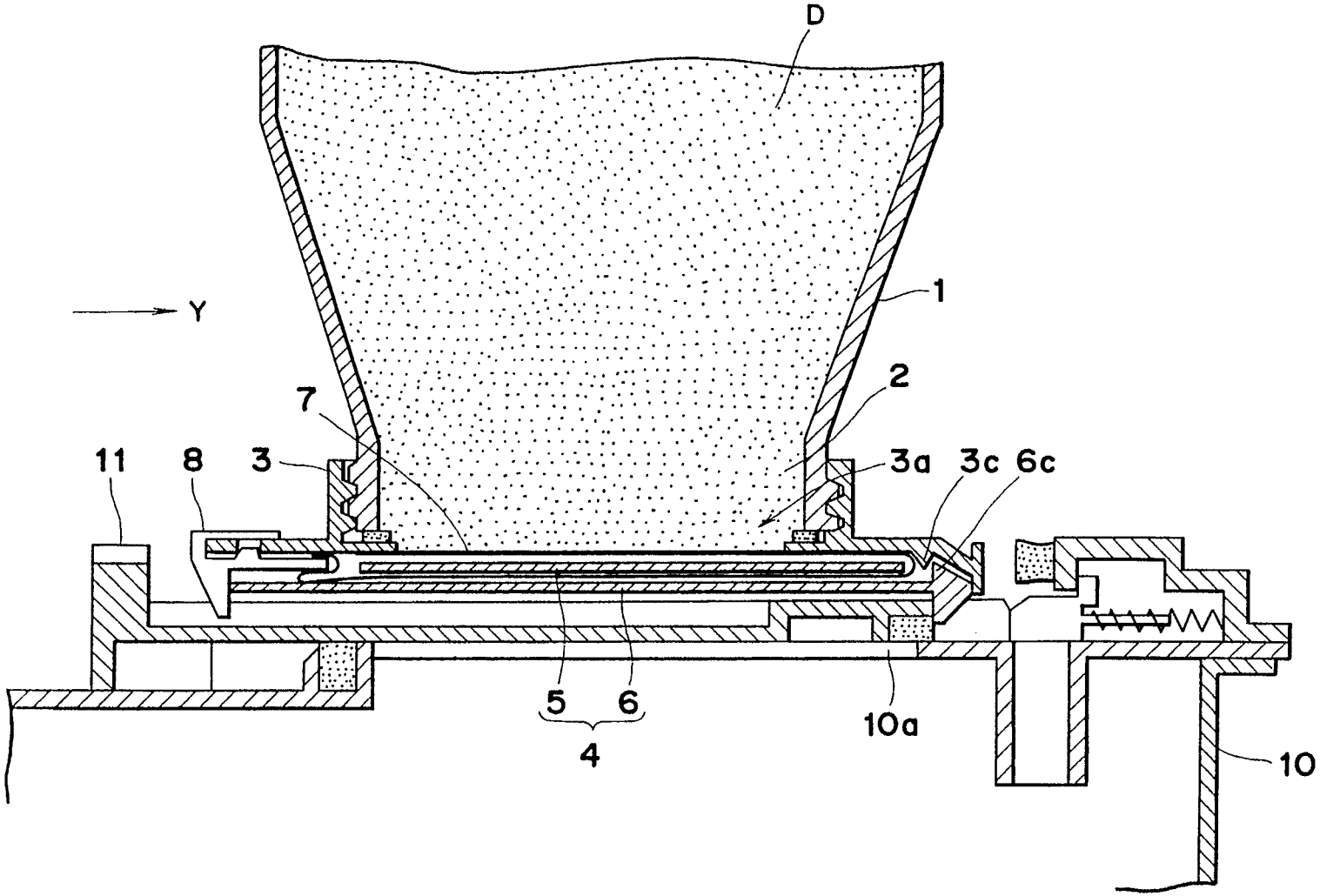
FIG. 16 is a sectional view taken along the XVI—XVI in FIG. 15.

In an embodiment shown in FIGS. 13 and 14, a developer cartridge comprises a container 1 which is made of synthetic resin. The container 1 is provided at its upper part with a developer discharge opening 2, and a male threaded portion 2*a* and a projection 2*b* are formed on an outer surface of a wall defining the discharge opening 2. The projection 2*b* is arranged adjacent to an end of the male thread 2*a* and is disposed on an extension line from the male thread 2*a*.

On the other hand, the table 3 is provided at its neck portion with a female threaded portion 3*d* which is adapted to engage with the male threaded portion 2*a* of the discharge opening 2. Further, a notch 3*e* as a recess is formed in the neck portion of the table 3.

When the table 3 is to be attached to the container 1, the table is rotated in a predetermined direction with respect to the container 1, thereby screwing or threading the male threaded portion 2*a* of the container 1 into the female threaded portion 3*d* of the table 3. When the table 3 is screwed onto the container until it is contacted with the projection 2*b* of the container 1, resistance will be felt due to contact between the projection 2*b* and an inner surface of the neck portion of the table 3. As the table 3 is further screwed onto the container 1 while elastically deforming the projection 2*b*, the notch 3*e* of the table 3 reaches the projection 2*b*, thereby reducing the resistance feeling considerably. In this point, since the threading between the male and female threads 2*a*, 3*d* is completed, it is possible to visually ascertain the fact that the predetermined threading is completed. As a result, the positional relation between the container 1 and the table 3 can be kept at a predetermined relation, with the result that, when the developer cartridge is mounted on the developer receiving device while using either the container 1 or the table 3 as a reference, the developer cartridge can be securely positioned at a predetermined position with respect to the developer receiving device.

When the developer cartridge having the table 3 threaded onto the container 1 is subjected to vibration during transportation of the cartridge, it may be feared that the table 3 is rotated with respect to the container 1. If the table 3 tries to rotate in a direction in which the female threaded portion 3*d* is unscrewed with respect to the male threaded portion 2*a*, since a further rotation of the table 3 with respect to the container 1 is prevented by abutting the edge of the notch 3*e* against the projection 2*b*, loosening between the table 3 and the container 1 will not occur.

The above-mentioned advantage was confirmed by effecting a vibration test and by comparing the cartridge according to this embodiment with a cartridge of a comparison example. Incidentally, the developer cartridge used as the comparison example does not have the notch 3*e* of the table 3 and the projection 2*b* of the container 1.

In the vibration test, the looseness between the table and the container was checked after the threading therebetween. In the developer cartridge according to this embodiment, table 3 was threaded onto the container 1 so that the projection 2*b* was positioned at a central portion of the notch 3*e*. After the vibration test, it was ascertained that the projection 2*b* was abutted against the edge defining the notch 3*e* of the table 3, thereby preventing any rotation of the table 3 with respect to the container 1.

To the contrary, in the developer cartridge according to the comparison example, after the vibration test, it was found that the table 3 was rotated with respect to the container 1 to generate the looseness between the table 3 and the container 1.

Further, in the developer cartridge according to this embodiment, it was confirmed that, when the table 3 was screwed onto the container 1 until the projection 2*b* reached within the notch 3*e*, the deviation in angle between a front portion of the container 1 and a front portion of the table 3 was very small and was in an acceptable range. To the contrary, in the developer cartridge according to the comparison example, it was found that the number of rotations of the table during the threading operation was not constant depending upon the deviation at a top end of the container (cut length of the container after the blow molding) for each cartridge, with the result that it was difficult to maintain the above-mentioned positional relation within the acceptable range.

As shown in FIGS. 15 to 22, a developing device used with the image forming apparatus has a developer receiving device or hopper 10. The developer receiving hopper 10 is provided with a receiving opening 10*a* for receiving the developer to be replenished. The receiving opening 10*a* is releasably closed by a shutter 11 slidable in a horizontal direction. The developer is replenished from the developer cartridge to the developer receiving hopper 10. When the cartridge is mounted on the developer receiving hopper 10, a shifting direction of the lid 4 of the developer cartridge is the same as that of the shutter 11.

The table 3 of the cartridge is releasably secured to the developer receiving hopper 10 via a securing member 13 formed on the developer receiving hopper 10. The securing member serves to secure the table 3 of the cartridge to the developer receiving hopper 10 and at the same time to release the shutter 11, thereby permitting the opening movement of the shutter 11.

On the developer receiving hopper 10, shutter 11 and grip 8, reference numbers 14, 15, 16, 17, 18, 19 for indicating the order of manipulating procedures, arrows 20, 21, 22, 23, 24, 25 for indicating manipulating directions, and indexes 26, 27 for indicating manipulating positions are embossed or printed.

The numbers 14, 15 and the arrow 20, 21 are printed on the upper surface of the table 3. The number 14 indicates the first order of the manipulating procedures and the arrow 20 indicates the shifting direction of the table 3 in the first manipulating procedure. The number 15 indicates the sixth order of the manipulating procedures and the arrow 21 indicates the shifting direction of the table 3 in the sixth manipulating procedure. The number 16, arrow 22 and indexes 26, 27 are printed on the upper surface of the developer receiving hopper 10. The number 16 indicates the second order of the manipulating procedures and the arrow 22 indicates the shifting direction of the securing member 13 in the second manipulating procedure. The index 26 indicates an open position of the shutter 11 and the index 27 indicates a closed position (shift end position) of the shutter 11.

The numbers 17, 18 and arrows 23, 24 are printed on the upper surface of the shutter 11. The number 17 indicates the third order of the manipulating procedures and the arrow 23 indicates the shifting direction of the shutter 11 in the third manipulating procedure. The number 18 indicates the fifth order of the manipulating procedures and the arrow 24 indicates the shifting direction of the shutter 11 in the fifth manipulating procedure. The number 19 and arrow 25 are printed on the upper surface of the grip 8. The number 19 indicates the fourth order of the manipulating procedures and the arrow 25 indicates the shifting direction of the grip 8 in the fourth manipulating procedure.

Next, the procedures for replenishing the developer cartridge to the developer receiving hopper 10 will be explained.

First, the developer cartridge is lowered onto the hopper 10 so that the table 3 rests on the hopper 10. In this manner, projections **3*f* formed on the table 3 are inserted into corresponding guide recesses 10*b* formed in the developer receiving hopper 10**.

Then, the manipulating procedures are started from the order shown by the number 14. The cartridge is shifted in the direction Y (FIG. 16) shown by the arrow 25 until the projections **3*f* of the table 3 are aligned with the guide recesses 10*b* of the hopper in an up-and-down direction, thereby preventing the cartridge from shifting with respect to the developer receiving hopper 10 in the up-and-down direction by the projections 3*f* and the guide recesses 10*b*. After the cartridge is fixed with respect to the developer receiving hopper 10 in the up-and-down direction, the manipulating procedures regarding the securing member 13 are started from the order indicated by the number 16. The securing member 13 is rotated in the direction indicated by the arrow 22, thereby preventing the cartridge from shifting with respect to the developer receiving hopper 10 in the horizontal direction. Further, the shutter 11 is disengaged from the securing member 13 by rotation of the latter, thus permitting the sliding movement of the shutter 11** in the direction X.

Figure 17:
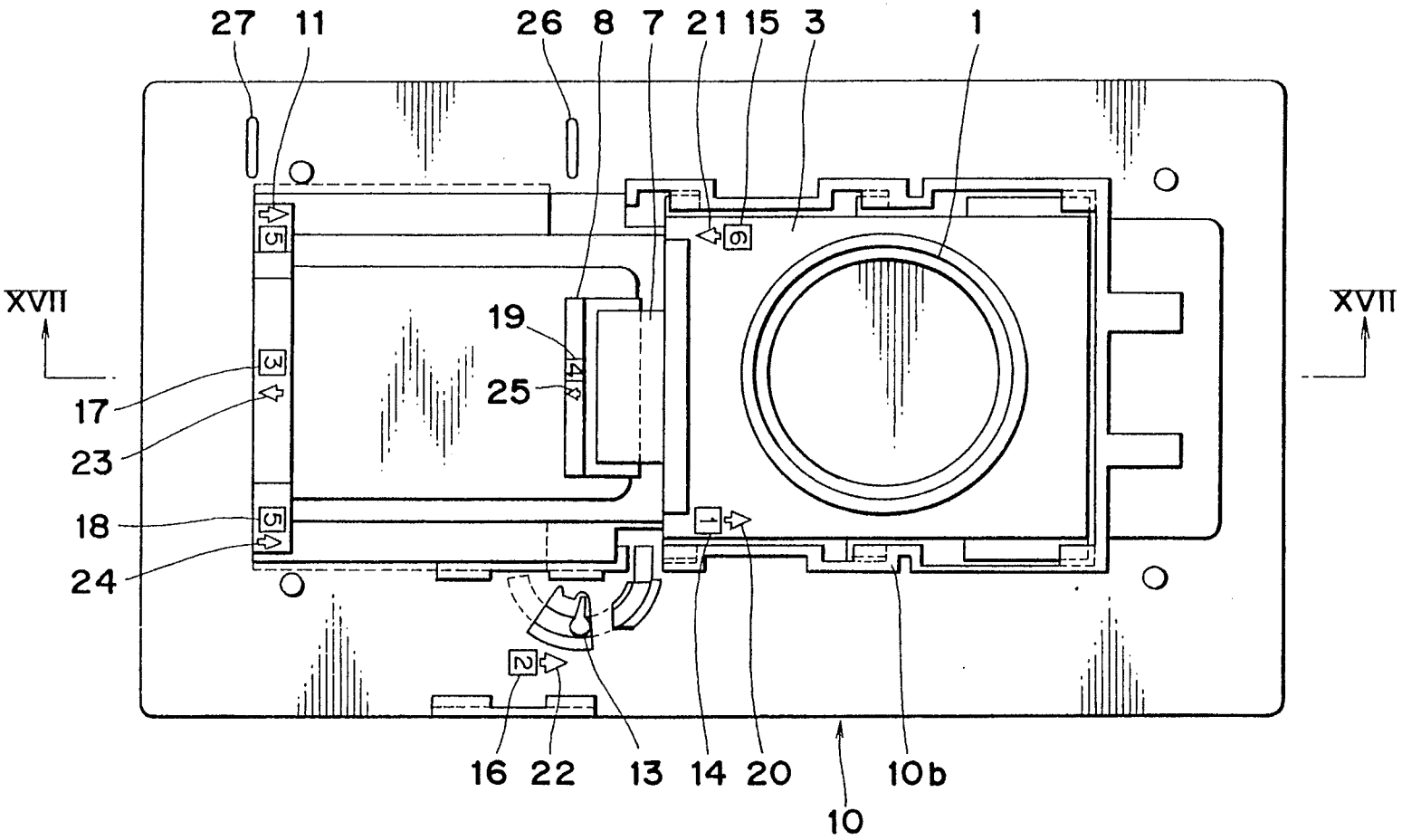
FIG. 17 is a plan view for explaining a process for opening a shutter of a container.
Figure 18:
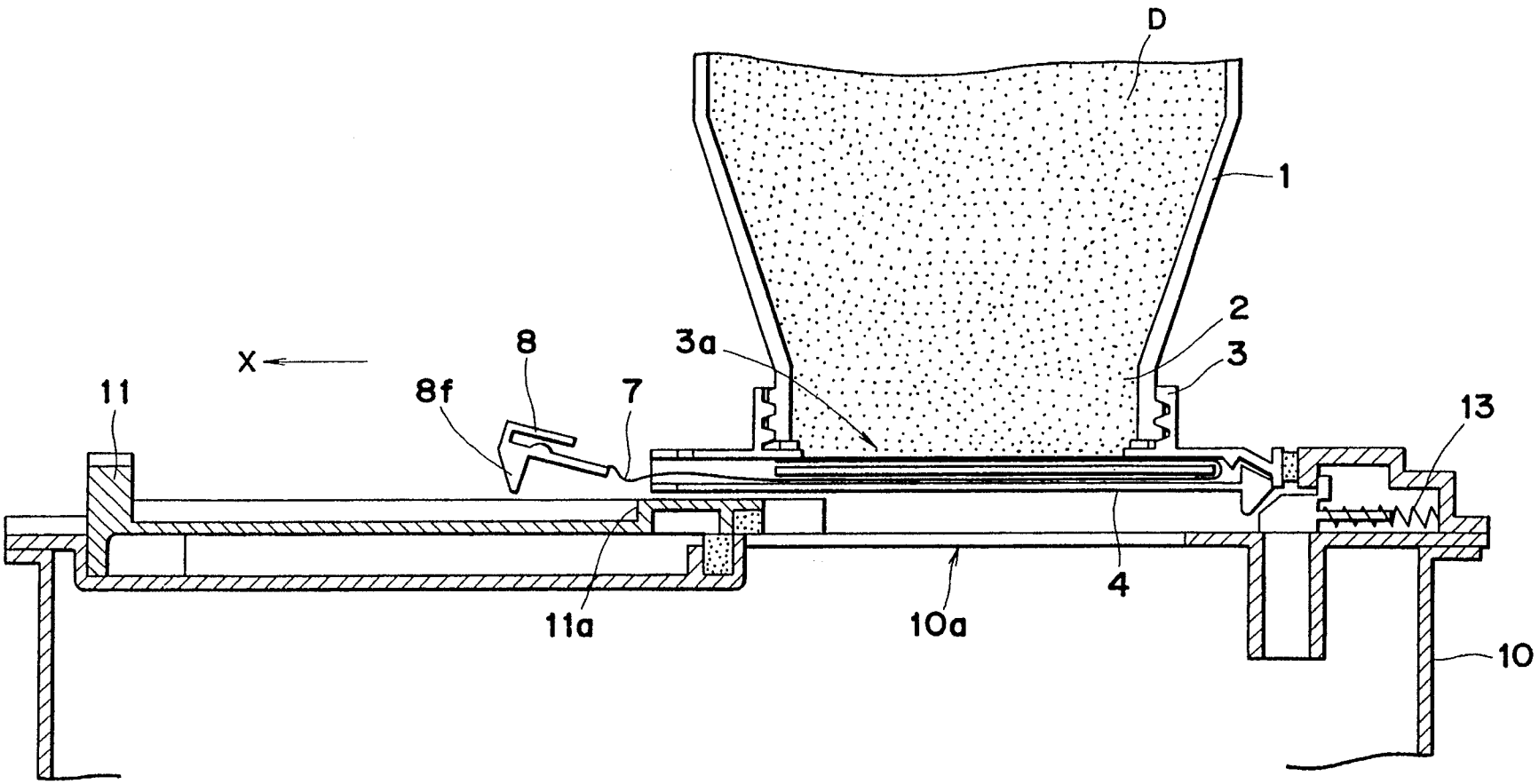
FIG. 18 is a sectional view taken along the line XVIII—XVIII in FIG. 17.

Then, the manipulating procedures regarding the shutter 11 are started from the order indicated by the number 17. As shown in FIGS. 17 and 18, the shutter 11 is pulled in the direction X indicated by the arrow 23 by the operator up to the open position indicated by the index 27. During the shifting movement of the shutter 11, since the grip 8 is urged toward the shifting direction of the shutter 11 by abutting an abutment portion **11*a* against a projection 8*f* of the grip 8, the grip 8 is separated from the table 3**.

When the shutter 11 is held in the open position shown in FIGS. 17 and 18, the securing member 13 cannot be rotated since it is abutted against the side surface of the shutter 11. Accordingly, the cartridge cannot be dismounted from the developer receiving hopper 10, thereby preventing any inadvertent dismounting of the cartridge during the developer replenishing operation.

Figure 19:
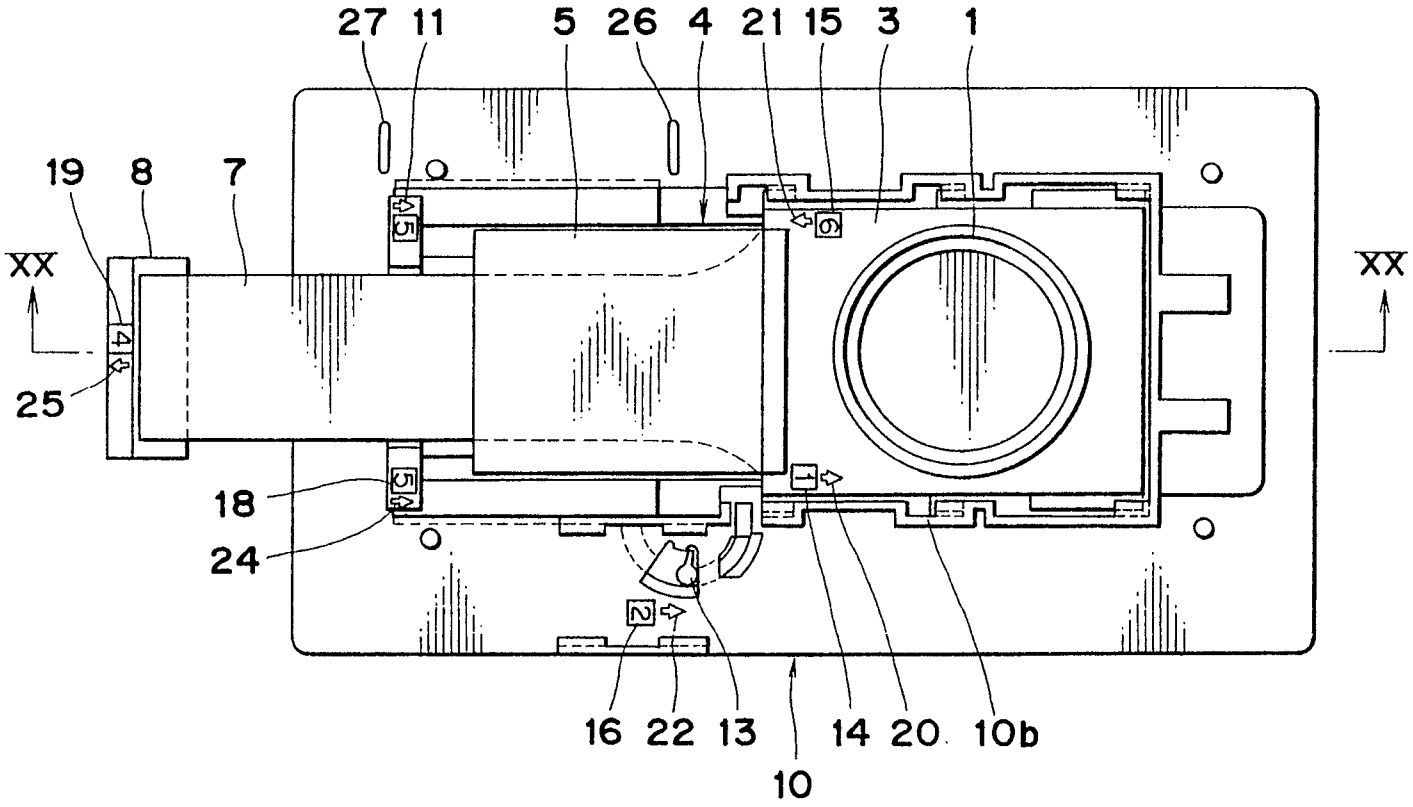
FIG. 19 is a plan view for explaining a process for pulling a film member of the cartridge.
Figure 20:
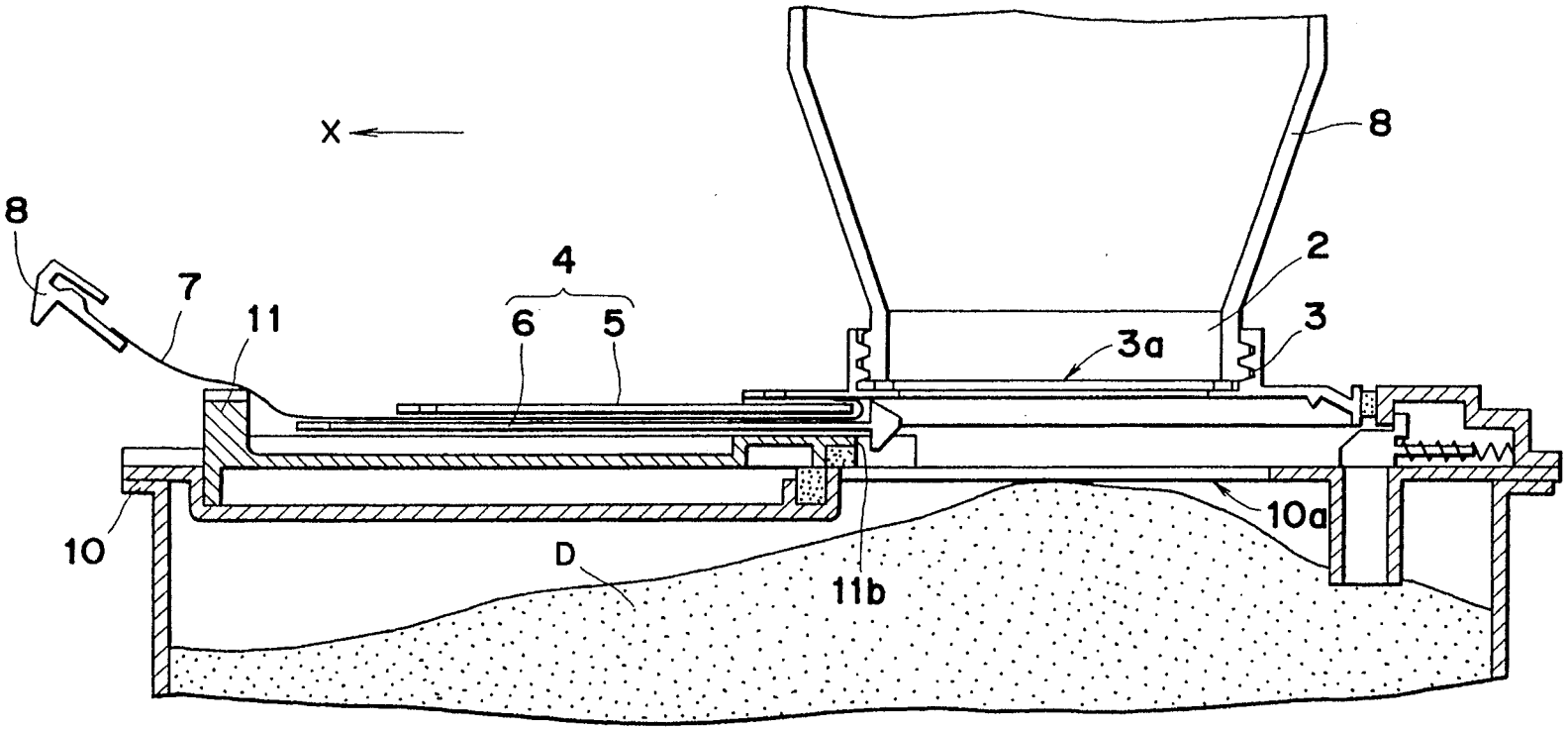
FIG. 20 is a sectional view taken along the line XX—XX in FIG. 19.

Then, the manipulating procedures regarding the grip 8 are started from the order indicated by the number 19. As shown in FIGS. 19 and 20, the grip is pulled in the direction X indicated by the arrow 25 by the operator, thereby pulling out the film member 7. As the film member 7 is pulled out, the lid 4 is shifted toward the direction X, thereby gradually opening the central opening **3*a* of the table 3. Further, the film member 7 is pulled out to the predetermined length, the lid 4 reaches the open position, thus opening the central opening 3*a* of the table 3 completely. When the opening 3*a* of the table 3 is opened, the developer D in the container 1 of the cartridge is replenished to the developer receiving hopper 10 through the discharge opening 2, central opening 3*a* of the table and the opening 10*a* of the hopper 10**.

Figure 21:
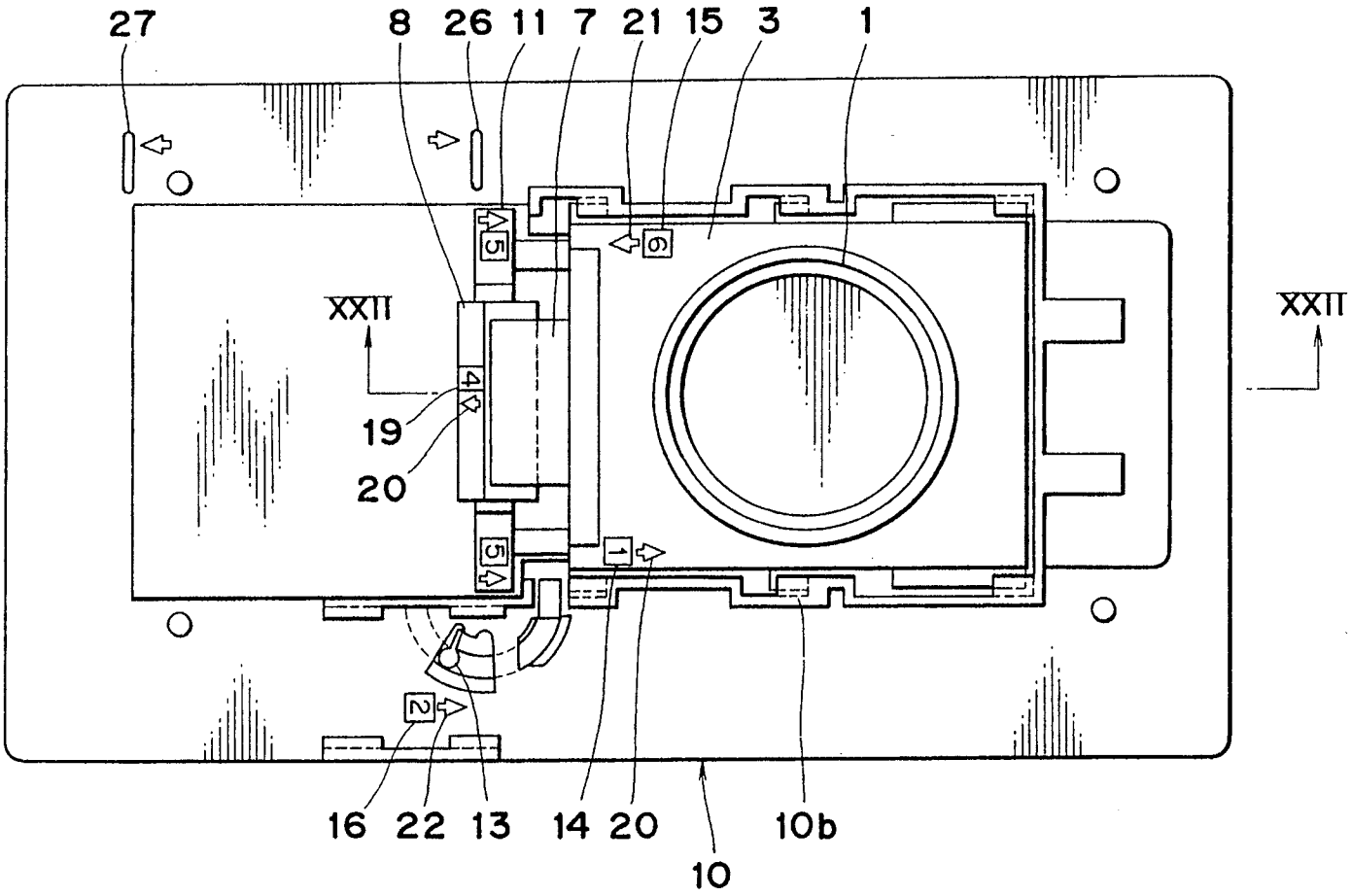
FIG. 21 is a plan view for explaining a process for closing the shutter of the container.
Figure 22:
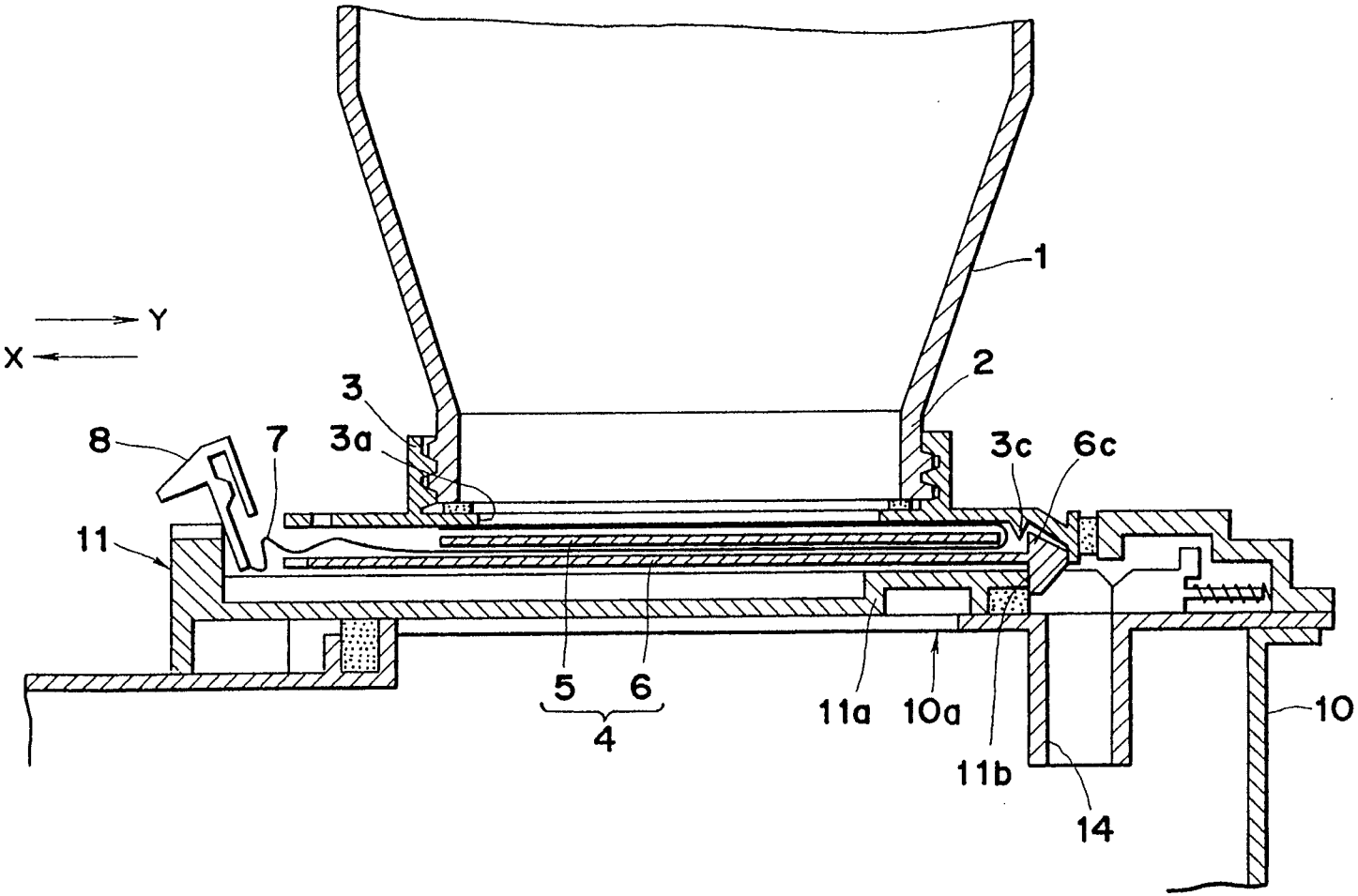
FIG. 22 is a sectional view taken along the line XXII—XXII in FIG. 21.

After the replenishment of the developer is completed, as shown in FIGS. 21 and 22, the manipulating procedures regarding the shutter 11 are started from the order indicated by the number 18. The shutter 11 is shifted in the direction Y indicated by the arrow 24 by the operator, so that an edge **11*b* of the shutter 11 is abutted against the projection 6*c* of the second lid portion 6. Consequently, the lid 4 is shifted toward its closed position as the shutter 11 is slidingly shifted. As the lid 4 is shifted in the direction Y, the film member 7 is withdrawn into the lid 4. Further, when the shutter 11 is shifted, the projection 6*c* of the second lid portion 6 rides over the stopper 3*c*, and then, a leading end of the projection 6*c* is abutted against a rear edge of the table 3. The shutter 11 is shifted while abutting the projection 6*c* against the table 3 until the opening 10*a* is completely closed. At this point, the shifting movement of the shutter 11 is finished. In this manner, the discharge opening 2 of the cartridge is also completely closed by the lid 4. In the completely closed position, the securing member 13 is rotated by a sequential mechanism (not shown) provided on the shutter 11, thereby releasing the securing between the table 3 and the developer receiving hopper 10** in the horizontal direction.

Then, the cartridge is shifted in the direction X so that the projections **3*f* of the table 3 are disengaged from the developer receiving hopper 10. Then, the cartridge is lifted to separate it from the developer receiving hopper 10**.

In this way, since the reference numbers for indicating the order of the manipulating procedures and the arrows for indicating the manipulating directions are printed on the surfaces near the corresponding elements, even a beginner can surely perform the complex manipulating procedures or steps regarding the replenishment of the developer without trouble.

Printing of the reference numbers and arrows may be effected by embossing the predetermined numbers and arrows in molds and by molding the various parts within the molds. According to this method, it is possible to obtain the above-mentioned numbers and arrows easily and cheaply. Alternatively, the numbers and arrows may be formed by the printing, etching or sand blasting, according to the materials of the various parts.

In the embodiment shown in FIGS. 5 and 6, while the projections 3*f* are not shown on the table 3, such projections 3*f* are actually formed on the table 3 in this embodiment.

What is claimed is:

1. A developer cartridge removably mountable on a developer receiving device, comprising:

a container for containing developer to be replenished to said developer receiving device, said container having a circumferential portion forming a developer discharge opening in said container;

a film member peelably adhered to said circumferential portion around said discharge opening of said container and having a first portion for sealingly closing said discharge opening, and a second portion continuous with said first portion and folded back over said first portion;

a plate-shaped lid member slidably supported by said container to open and close said discharge opening, said lid member comprising first and second lid portions opposed to each other with a gap therebetween, said first lid portion having a first engagement portion and said second lid portion having a second engagement portion so that said first and second lid portions are interconnected by engaging said first engagement portion with said second engagement portion, said second portion of said film member extending through said gap between said first and second lid portions; and a grip, fixed to a free end of said second portion of said film member, for pulling said film member through said gap, said grip being releasably supported by said container and having a hold-down portion for holding down said lid member relative to said container.

2. A developer cartridge according to claim 1, wherein said second lid portion is positioned outside said first lid portion, and said hold-down portion of said grip holds down an outer surface of said second lid portion.

3. A developer cartridge according to claim 1, wherein said first engagement portion of said first lid portion comprises a hooked projection and said second engagement portion of said second lid portion comprises a hole into which said hooked projection can be inserted.

4. A developer cartridge according to claim 2, wherein said first engagement portion of said first lid portion comprises a hooked projection and said second engagement portion of said second lid portion comprises a hole into which said hooked projection can be inserted.

5. A developer cartridge removably mountable on a developer receiving device, comprising:

a container for containing developer to be replenished to said developer receiving device, said container having a circumferential portion forming a developer discharge opening in said container, and a table portion removably mountable on said developer receiving device;

a film member peelably adhered to said circumferential portion around said discharge opening of said container and having a first portion for sealingly closing said discharge opening, and a second portion continuous with said first portion and folded back over said first portion;

a plate-shape lid member slidably supported by said container to open and close said discharge opening, said lid member comprising first and second lid portions opposed to each other with a gap therebetween, said second portion of said film member extending through said gap between said first and second lid portions; and a grip, fixed to a free end of said second portion of said film member, for pulling said film member through said gap, said grip being releasably supported by said container;

wherein said table portion and said grip include reference numbers thereon for indicating an order of manipulating procedures for replenishing the developer to said developer receiving device, and indications for indicating manipulating directions.

6. A developer cartridge removably mountable on a developer receiving device, comprising:

a container body for containing developer to be replenished to said developer receiving device, said container body having a first threaded portion;

a table member having a circumferential portion forming a developer discharge opening therein and having a second threaded portion for mating with said first threaded portion by rotating in a forward direction of rotation;

a film member peelably adhered to said circumferential portion around said discharge opening of said table member and having a first portion for sealingly closing said discharge opening, and a second portion continuous with said first portion and folded back over said first portion;

a plate-shaped lid member slidably supported by said table member to open and close said discharge opening, said lid member comprising first and second lid portions opposed to each other with a gap therebetween, said second portion of said film member extending through said gap between said first and second lid portions; and a grip, fixed to a free end of said second portion of said film member, for pulling said film member through said gap, said grip being releasably supported by said table member;

wherein said container body has a projection, and said table member has a recess for receiving said projection when said first and second threaded portions are threadably mated, to prevent rotation of said table member relative to said container body in a reverse direction of rotation.

* * * * *

UNITED STATES PATENT AND TRADEMARK OFFICE

CERTIFICATE OF CORRECTION

PATENT NO. : 5,351,728

DATED : October 4, 1994

INVENTOR(S) : BAN ET AL.

It is certified that error appears in the above-indentified patent and that said Letters Patent is hereby corrected as shown below: Title Page:

AT [56] U.S. PATENT DOCUMENTS

"Yoshimo et al" should read --Yoshino et al.--
"Furata" should read --Furuta--.
"Kareda et al." should read --Kaieda et al.--

AT [56] FOREIGN PATENT DOCUMENTS

"171761 5/1989 Japan
171762 5/1989 Japan
01223483 9/1989 Japan
3102371 4/1991 Japan"

should read

--1-171761 5/1989 Japan
1-171762 5/1989 Japan
1-223483 9/1989 Japan
3-102371 4/1991 Japan--.

At [57] ABSTRACT

Line 12, "gaps" should read --gap--.

Column 3

Line 66, "(corresponding" should read --(corresponding to--.

UNITED STATES PATENT AND TRADEMARK OFFICE

CERTIFICATE OF CORRECTION

PATENT NO. :5,351,728

DATED :October 4, 1994

INVENTOR(S) :BAN ET AL.

It is certified that error appears in the above-indentified patent and that said Letters Patent is hereby corrected as shown below:

Column 4

Line 62, "Incidentally," should read --Of course,--.

Column 5

Line 4, "portion" should read --portion,--.

Column 6

Line 5, "the" (second occurrence) should be deleted.
Line 9, "swelled" should read --swell--.
Line 39, "then" should read --they--.

Column 7

Line 20, "closed" should read --closed by--.

Column 8

Line 24, "comparison" should read --comparative--.
Line 25, "comparison" should read --comparative--.
Line 39, "comparison" should read --comparative--.
Line 50, "comparison" should read --comparative--.

Column 11

Line 29, "container" should read --container,--.

UNITED STATES PATENT AND TRADEMARK OFFICE

CERTIFICATE OF CORRECTION

PATENT NO. : 5,351,728 Page 3 of 3

DATED : October 4, 1994

INVENTOR(S) : BAN ET AL.

It is certified that error appears in the above-indentified patent and that said Letters Patent is hereby corrected as shown below:

Column 12

Line 13, "container" should read --container,--.
Line 39, "therein" should read --therein,--.

Signed and Sealed this

Seventh Day of March, 1995

*Attest:*

*Attesting Officer*

BRUCE LEHMAN

*Commissioner of Patents and Trademarks*